US011313623B2

(12) United States Patent
Saitou et al.

(10) Patent No.: US 11,313,623 B2
(45) Date of Patent: Apr. 26, 2022

(54) HEAT EXCHANGER

(71) Applicant: DENSO CORPORATION, Kariya (JP)

(72) Inventors: Masafumi Saitou, Kariya (JP); Akira Yamanaka, Kariya (JP); Masaki Harada, Kariya (JP); Kenji Yamada, Kariya (JP); Kazutaka Suzuki, Kariya (JP); Taichi Asano, Kariya (JP); Shota Terachi, Kariya (JP)

(73) Assignee: DENSO CORPORATION, Kariya (JP)

( * ) Notice: Subject to any disclaimer, the term of this patent is extended or adjusted under 35 U.S.C. 154(b) by 656 days.

(21) Appl. No.: 15/550,992

(22) PCT Filed: Feb. 29, 2016

(86) PCT No.: PCT/JP2016/056126

§ 371 (c)(1),
(2) Date: Aug. 14, 2017

(87) PCT Pub. No.: WO2016/140203

PCT Pub. Date: Sep. 9, 2016

(65) Prior Publication Data

US 2018/0023898 A1 Jan. 25, 2018

(30) Foreign Application Priority Data

Mar. 2, 2015 (JP) ..... JP2015-040553
Apr. 1, 2015 (JP) ..... JP2015-075287
Nov. 26, 2015 (JP) ..... JP2015-230897

(51) Int. Cl.
*F28F 9/00* (2006.01)
*F28D 9/00* (2006.01)
*F28F 9/02* (2006.01)

(52) U.S. Cl.
CPC ..... *F28D 9/0056* (2013.01); *F28D 9/0043* (2013.01); *F28F 9/001* (2013.01);
(Continued)

(58) Field of Classification Search
CPC .. F28F 9/00; F28F 9/0226; F28F 9/001; F28F 9/0224; F28F 9/0219; F28F 9/12;
(Continued)

(56) References Cited

U.S. PATENT DOCUMENTS 3,111,237 A * 11/1963 Hagmann ..... B65D 51/145 215/337
3,939,908 A * 2/1976 Chartet ..... F28D 1/05333 165/149

(Continued)

FOREIGN PATENT DOCUMENTS

FR 2855605 A1 * 12/2004 ..... F02B 29/0462
JP 2011-232020 A 11/2011
WO WO-2013092642 A1 6/2013

*Primary Examiner* — Harry E Arant
(74) *Attorney, Agent, or Firm* — Harness, Dickey & Pierce, P.L.C.

(57) ABSTRACT

A heat exchanger includes a duct, a stacked core, and a coupling plate. The duct includes a first plate that is disposed to face at least one of end faces of the stacked core in a core width direction, and a second plate that is disposed to face at least one of the end faces of the stacked core in a tube stacking direction. The second plate includes a second-plate end plate portion disposed to face the end face of the stacked core in the core width direction and brazed to a wall surface of the first plate, a second-plate center plate portion that is disposed to face the end face of the stacked core in the tube stacking direction, and a flange portion that extends in the tube stacking direction and is brazed to a bottom wall surface of a groove portion of the coupling plate.

30 Claims, 20 Drawing Sheets

(52) U.S. Cl.
CPC ..... *F28F 9/0226* (2013.01); *F28F 2275/04* (2013.01); *F28F 2275/122* (2013.01)

(58) Field of Classification Search
CPC .. F28F 9/0043; F28F 2275/00; F28F 2275/04; F28F 2275/06; F28F 2275/122; F28F 9/182; F28D 7/1661; A47L 15/0047; F02B 29/045
See application file for complete search history.

(56) References Cited

U.S. PATENT DOCUMENTS

| | | | | |
|---|---|---|---|---|
| 6,082,448 | A * | 7/2000 | Haussmann | F28D 1/05391 165/158 |
| 9,157,686 | B2 * | 10/2015 | Amaya | F02B 29/0462 |
| 2003/0196785 | A1 * | 10/2003 | Knecht | F28D 7/1684 165/148 |
| 2006/0048759 | A1 * | 3/2006 | Hendrix | F28F 9/02 123/563 |
| 2006/0219394 | A1 * | 10/2006 | Martin | F28D 9/0043 165/157 |
| 2011/0168370 | A1 * | 7/2011 | Garret | F28F 9/0219 165/158 |
| 2011/0247318 | A1 | 10/2011 | Kuroyanagi et al. | |
| 2013/0092360 | A1 * | 4/2013 | Day | F28F 3/08 165/166 |
| 2013/0146267 | A1 * | 6/2013 | Garret | F28D 7/1684 165/175 |
| 2017/0016684 | A1 * | 1/2017 | Okubo | F16L 25/0009 |

* cited by examiner

HEAT EXCHANGER

CROSS REFERENCE TO RELATED APPLICATIONS

This application is a U.S. National Phase Application under 35 U.S.C. 371 of International Application No. PCT/JP2016/056126 filed on Feb. 29, 2016 and published in Japanese as WO 2016/140203 A1 on Sep. 9, 2016. This application is based on and claims the benefit of priority from Japanese Patent Applications No. 2015-040553 filed on Mar. 2, 2015, No. 2015-075287 filed on Apr. 1, 2015, and No. 2015-230897 filed on Nov. 26, 2015. The entire disclosures of all of the above applications are incorporated herein by reference.

TECHNICAL FIELD

The present disclosure relates to a heat exchanger in which a stacked core in which multiple tubes are stacked on each other is accommodated in a duct.

BACKGROUND ART

Up to now, one of the heat exchanger of this type is disclosed in, for example, Patent Literature 1. In the heat exchanger disclosed in Patent Literature 1, a stacked core is accommodated in a duct, and a coupling plate for coupling an external pipe to the duct is coupled to an end portion of the duct.

In manufacturing the heat exchanger configured as described above, outer fins are arranged between flat tubes and temporarily assembled together, the temporarily assembled stacked core is accommodated in the duct, the duct is fitted in a groove portion of the coupling plate, and the coupling plate and the duct are brazed together.

PRIOR ART LITERATURE

Patent Literature

Patent Literature 1: WO 2013/092642

SUMMARY

According to the inventors' study, in a conventional heat exchanger, a dimension of the stacked core in a tube stacking direction decreases due to melting of a brazing material during brazing. On the other hand, the duct is fitted in the groove portion of the coupling plate, a position of the duct is determined by the groove portion of the coupling plate, and the dimension of the duct in the tube stacking direction does not change.

Therefore, according to the inventors' study, a reduction in the dimension of the stacked core at the time of brazing causes a gap to be provided between the outer fins and the duct, and between the tube and the outer fins, resulting in a possibility that a brazing failure occurs between the respective duct, outer fins, and tube. In view of the above difficulties, it is an objective of the present disclosure to prevent a brazing failure from occurring.

In order to achieve the above-described objective, according to an aspect of the present disclosure, a heat exchanger includes: a duct including at least two plates combined into a tubular shape, a first fluid flow channel provided inside the duct through which a first fluid passes, an inflow port for the first fluid on one end of the first fluid flow channel, and an outflow port for the first fluid on another end of the first fluid flow channel; a stacked core that is accommodated in the duct and includes a plurality of tubes having flat shapes and being stacked, a second fluid flow channel provided inside each of the plurality of tubes through which a second fluid passes, and outer fins arranged between adjacent tubes of the plurality of tubes, the tubes and the outer fins being brazed to each other; and a coupling plate that is brazed to the duct and has a groove portion defining a peripheral edge of the inflow port or the outflow port. A direction intersecting with a tube stacking direction and a first fluid flow direction is defined as a core width direction. The duct includes a first plate disposed to face at least one of end faces of the stacked core in the core width direction, and a second plate disposed to face at least one of end faces of the stacked core in the tube stacking direction. The second plate includes a second-plate end plate portion disposed to face the end face of the stacked core in the core width direction and brazed to a wall surface of the first plate, a second-plate center plate portion disposed to face the end face of the stacked core in the tube stacking direction, and a flange portion that extends in the tube stacking direction and is brazed to a bottom wall surface of the groove of the coupling plate.

According to the above configuration, the first plate and the second plate can move relative to each other in the tube stacking direction at the time of brazing, and the second plate follows and moves according to a dimensional change of the stacked core at the time of brazing. Therefore, a gap is less likely to be provided between the outer fins and the plate or between the tube and the outer fins at the time of brazing, and a brazing failure is prevented from occurring. In addition, since the second plate has the flange portion extending in the stacking direction of the tube, even if a dimension of the stacked core changes in the tube stacking direction, a structure in which the flange portion and the bottom wall surface of the groove portion of the coupling plate are brazed to each other can be maintained.

According to another aspect, a heat exchanger includes: a duct including at least two plates combined into a tubular shape, a first fluid flow channel provided inside the duct through which a first fluid passes, an inflow port for the first fluid on one end of the first fluid flow channel, and an outflow port for the first fluid on another end of the first fluid flow channel; a stacked core that is accommodated in the duct and includes a plurality of tubes having flat shapes and being stacked, a second fluid flow channel provided inside each of the plurality of tubes through which a second fluid passes, and outer fins arranged between adjacent tubes of the plurality of tubes, the tubes and the outer fins being brazed to each other; and a coupling plate that is blazed to the duct and has a groove portion defining a peripheral edge of the inflow port or the outflow port. The duct includes a first plate having a wall surface extending in a tube stacking direction, and a second plate disposed to face at least one of end faces of the stacked core in the tube stacking direction. The second plate includes a second-plate end plate portion that extends in the tube stacking direction and is brazed to a wall surface of the first plate, a second-plate center plate portion disposed to face the end face of the stacked core in the tube stacking direction, and a flange portion that extends from at least the second-plate center plate portion in the tube stacking direction and is brazed to a bottom wall surface of the groove of the coupling plate.

According to the above configuration, the same actions and effects as those of the heat exchanger according to the one aspect are obtained.

According to another aspect, a heat exchanger includes: a duct including a first plate and a second plate combined into a tubular shape, a first fluid flow channel provided inside the duct through which a first fluid passes, an inflow port for the first fluid on one end of the duct in a first fluid flow direction, and an outflow port for the first fluid on another end of the duct in the first fluid flow direction; a stacked core that is accommodated in the duct and includes a plurality of tubes having flat shapes and being stacked, a second fluid flow channel provided inside each of the plurality of tubes through which a second fluid passes, and outer fins arranged between adjacent tubes of the plurality of tubes, the tubes and the outer fins being brazed to each other; and coupling plates that have frame shapes and are brazed to both end portions of the duct in the first fluid flow direction to define the inflow port and the outflow port. A direction perpendicular to a tube stacking direction and the first fluid flow direction is defined as a core width direction. The first plate includes first- plate both end plate portions disposed to face both end faces of the stacked core in the core width direction and brazed to the stacked core, a first-plate center plate portion disposed to face one end face of the stacked core in the tube stacking direction and brazed to the stacked core, and first plate flange portions that extend outward in a direction away from the first fluid flow channel from both end portions of the first plate in the first fluid flow direction and have surfaces facing the coupling plates and being perpendicular to the first fluid flow direction. The second plate includes second-plate both end plate portions disposed to face both end faces of the stacked core in the core width direction and brazed to the stacked core, a second-plate center plate portion disposed to face another end face of the stacked core in the tube stacking direction and brazed to the stacked core, and second plate flange portions that extend outward in a direction away from the first fluid flow channel from both end portions of the second plate in the first fluid flow direction and have surfaces facing the coupling plate and being perpendicular to the first fluid flow direction. The first-plate both end plate portions and the second-plate both end plate portions are brazed at positions where overlapped with each other in the core width direction. The first plate flange portions and the second plate flange portions are brazed to bottom wall surfaces of the coupling plates which are perpendicular to the first fluid flow direction.

According to another aspect, a heat exchanger, includes: a duct including a first plate and a second plate combined into a tubular shape, a first fluid flow channel provided inside the duct through which a first fluid passes, an inflow port for the first fluid on one end of the duct in a first fluid flow direction, and an outflow port for the first fluid on another end of the duct in the first fluid flow direction; a stacked core that is accommodated in the duct and includes a plurality of tubes having flat shapes and being stacked, a second fluid flow channel provided inside each of the plurality of tubes through which a second fluid passes; and a coupling plate that is blazed to the duct and includes a groove portion defining the inflow port or the outflow port. The first plate includes a pair of first-plate both end plate portions that extends in a tube stacking direction, a first-plate center plate portion that connects the first-plate both end plate portions to each other and is disposed to face one end face of the stacked core in the tube stacking direction, a first plate flange portion that extends from the first-plate center plate portion and the first-plate both end plate portions in the tube stacking direction and is brazed to a bottom wall surface of the groove portion of the coupling plate. The second plate includes a pair of second-plate both end plate portions that extend in the tube stacking direction and are overlapped with and brazed to the first-plate both end plate portions, a second-plate center plate portion that connects the second-plate both end plate portions to each other and is disposed to face another end face of the stacked core in the tube stacking direction, and a second plate flange portion that extends from the second-plate center plate portion and the second-plate both end plate portions in the tube stacking direction and is brazed to the bottom wall surface of the groove portion of the coupling plate.

According to the above configurations, the first plate and the second plate can move relative to each other according to the dimensional change of the stacked core at the time of brazing. Therefore, a gap is less likely to be provided between the outer fins and the plate or between the tube and the outer fins at the time of brazing, and a brazing failure is prevented from occurring.

DESCRIPTION OF EMBODIMENTS

Figure 1:
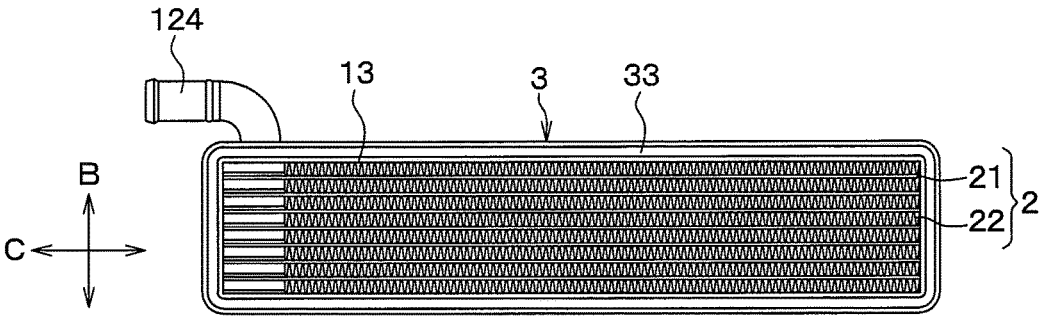
FIG. 1 is a front view of a heat exchanger according to a first embodiment.

Hereinafter, embodiments will be described referring to drawings. In the respective embodiments, portions which are the same as or equivalent to each other are assigned the same reference in the drawings.

First Embodiment

A first embodiment will be described. A heat exchanger according to the present embodiment serves as an intercooler that cools an intake air by exchanging a heat between the intake air that has been pressurized by a supercharger to a high temperature and a coolant fluid (for example, LLC, that is, long life coolant).

Figure 2:
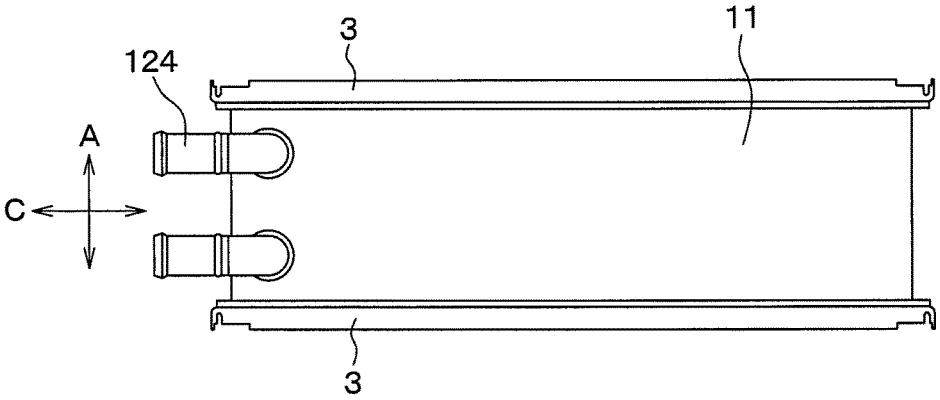
FIG. 2 is a top view of the heat exchanger in FIG. 1.
Figure 3:
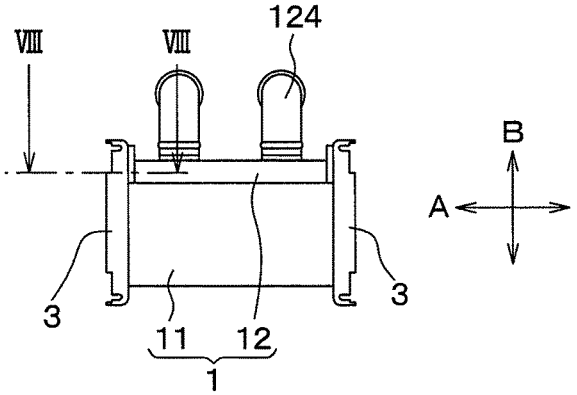
FIG. 3 is a right side view of the heat exchanger in FIG. 1.

As illustrated in FIGS. 1 to 3, the heat exchanger includes a tubular duct 1 through which an intake air as a first fluid flows, a stacked core 2 that is accommodated in the duct 1, and coupling plates 3 that are brazed to the respective end portions of the duct 1 as main components.

Figure 9:
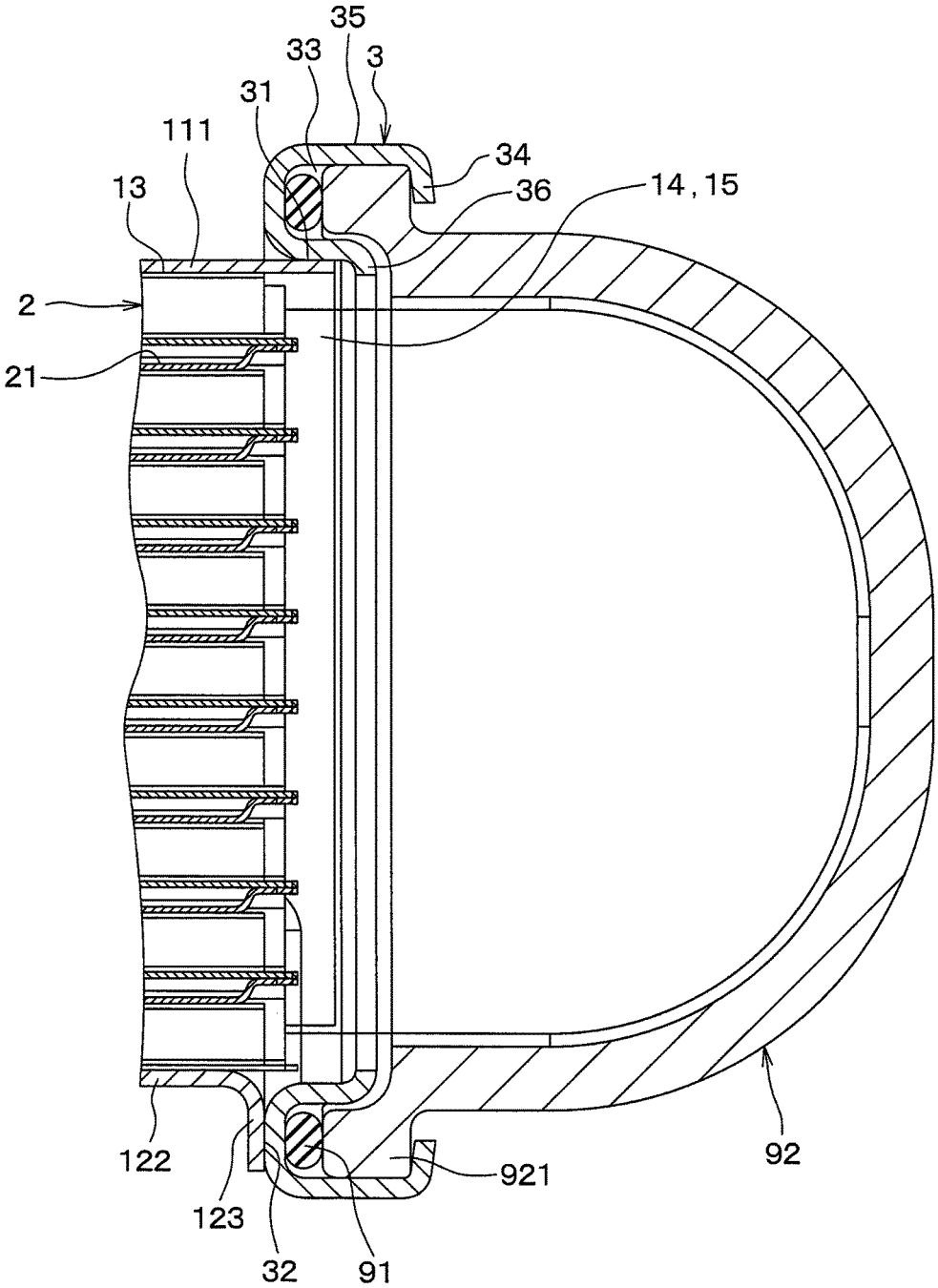
FIG. 9 is a cross-sectional view illustrating a coupling portion of a heat exchanger and an external piping member according to a first embodiment.

As illustrated in FIGS. 1 to 6, the duct 1 includes a first plate 11 and a second plate 12 formed by press molding a metal thin plate made of aluminum or the like in a predetermined shape, and an intake flow channel 13 through which an intake air flows is provided inside of the duct 1. As illustrated in FIG. 9, the intake air flows into the intake flow channel 13 from an inflow port 14 on one end side of the duct 1, flows in the intake flow channel 13, and flows out from an outflow port 15 on the other end side of the duct 1 to the outside.

Figure 7:
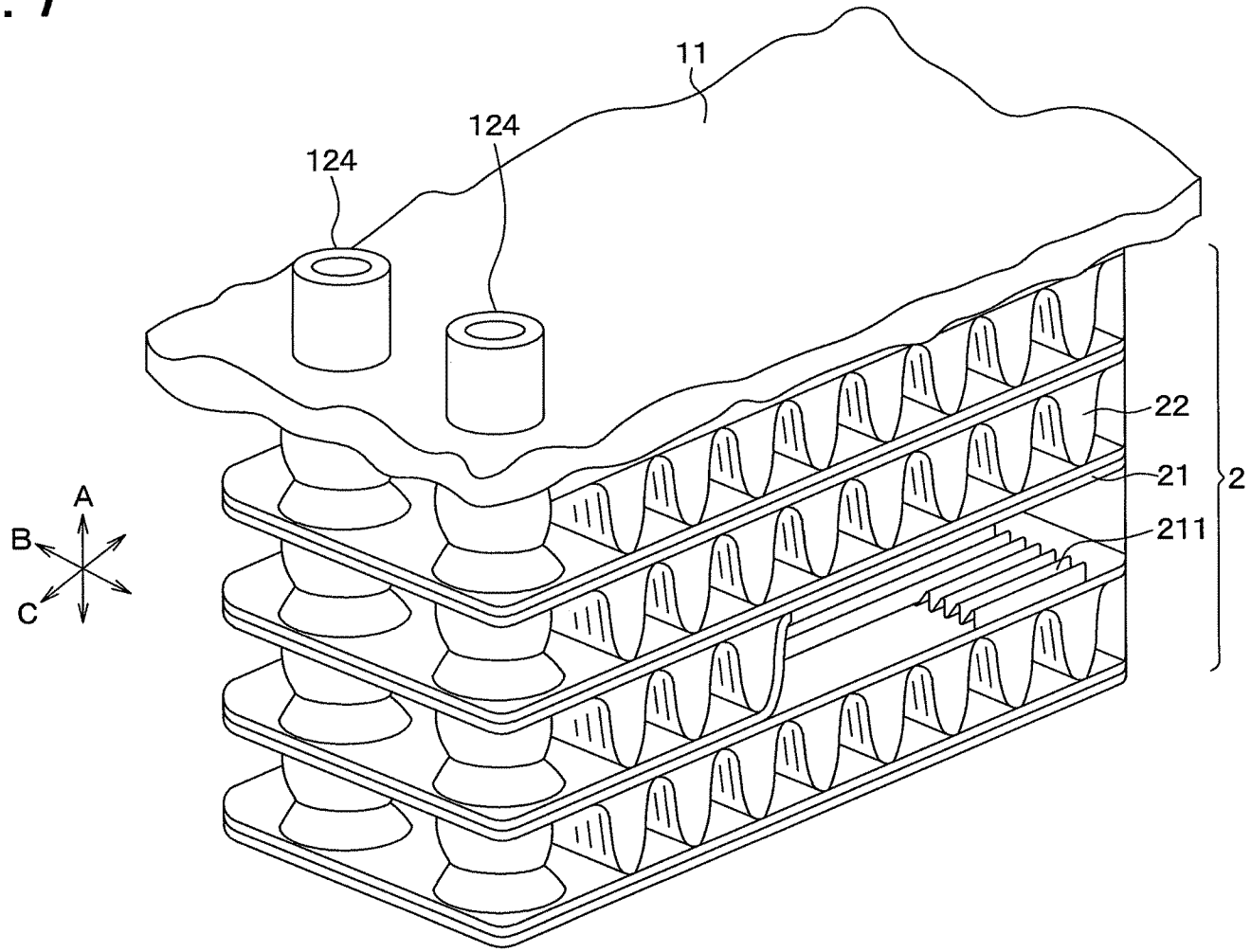
FIG. 7 is a perspective view schematically illustrating a configuration of a stacked core in the heat exchanger of FIG. 1, with a part of the duct broken.

As illustrated in FIG. 7, in the stacked core 2, multiple tubes 21 having a flattened cross section in which a flow channel through which a cooling fluid as a second fluid flows is provided are arranged. Inner fins 211 that promote a heat exchange with an increase in a heat transfer area may be arranged within the tubes 21. The tubes 21 are made of a metal such as aluminum in which a brazing material is clad on surfaces of the tubes 21.

The intake air passes between adjacent tubes 21, and outer fins 22 are arranged between the adjacent tubes 21 for the purpose of increasing the heat transfer area to promote the heat exchange. The outer fins 22 are each formed by corrugating a metal thin plate made of aluminum or the like, and are joined to the tubes 21 by brazing.

Hereinafter, a flow direction of the intake air in the duct 1 is referred to as a first fluid flow direction A. Further, a stacking direction of the tubes 21 is referred to as a tube stacking direction B. Further, a direction perpendicular to the first fluid flow direction A and the tube stacking direction B is referred to as a core width direction C. It should be noted that the core width direction C may be a direction intersecting with the first fluid flow direction A and the tube stacking direction B.

As illustrated in FIGS. 1 to 7, the first plate 11 includes first-plate end plate portions 111 that are disposed to face respective end faces of the stacked core 2 in the core width direction C and brazed to the respective end faces of the stacked core 2, and a first-plate center plate portion 112 which is disposed to face one end face of the stacked core 2 in the tube stacking direction B, connects the first-plate end plate portions 111 to each other, and is brazed to the end face of the stacked core 2. Each of the first-plate end plate portions 111 has a plate surface extending in the tube stacking direction B.

The second plate 12 includes second-plate end plate portions 121, a second-plate center plate portion 122, and flange portions 123. The second-plate end plate portions 121 are disposed to face respective end faces of the stacked core 2 in the core width direction C, and each have a plate surface extending in the tube stacking direction B. The second plate 12 overlaps with partial regions of the first-plate end plate portions 111 in the core width direction C and is brazed to outer wall surfaces of the first-plate end plate portions 111.

The second-plate center plate portion 122 is disposed to face the other end face of the stacked core 2 in the tube stacking direction B, connects the second-plate end plate portions 121 to each other, and is brazed to the other end face of the stacked core 2.

The flange portions 123 extend toward an outside that is a side opposite to the intake flow channel 13 from end portions of the second-plate end plate portions 121 and the second-plate center plate portion 122 at both end portions of the second plate 12 in the first fluid flow direction A. Each of the flange portions 123 has a surface extending in the tube stacking direction B when assembled to the stacked core 2, the first plate 11, and the coupling plate 3, and is disposed to face the coupling plate 3. In the present embodiment, the tube stacking direction B is a direction perpendicular to the first fluid flow direction A.

The second plate 12 includes pipes 124 to which piping not shown through which a cooling fluid flows is connected. An external heat exchanger not shown which cools the cooling fluid and the heat exchanger of the present embodiment are connected to each other by the piping.

The first plate 11 and the second plate 12 are combined together to form the duct 1, thereby forming the intake flow channel 13. A shape of the intake flow channel 13 when viewed along the first fluid flow direction A is substantially rectangular.

Each coupling plate 3 is formed in a substantially rectangular frame shape by press molding a metal thin plate made of aluminum or the like, and is brazed to the end portion of the duct 1 so as to surround the inflow port 14 or the outflow port 15.

Figure 8:
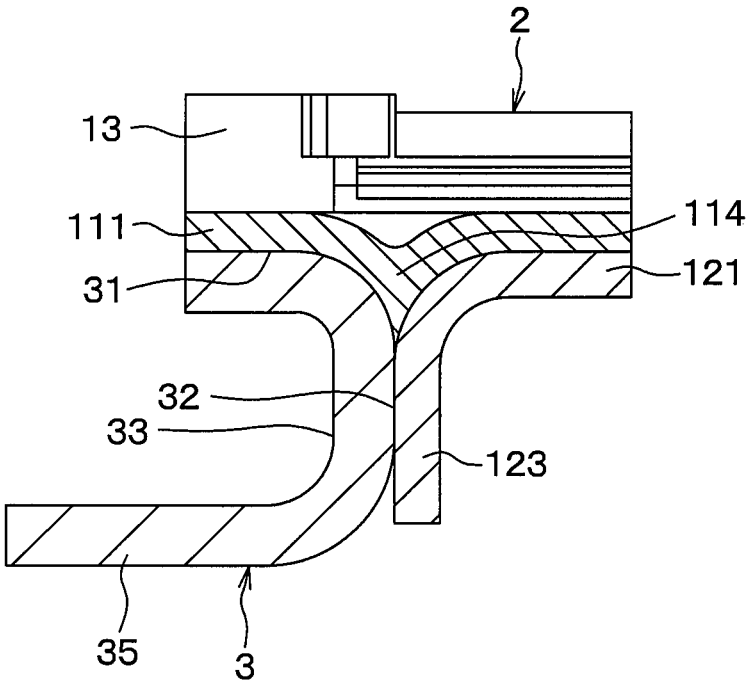
FIG. 8 is a cross-sectional view of a line VIII-VIII in FIG. 3.

As illustrated in FIG. 9, each coupling plate 3 is formed with a groove portion 33 having a U-shaped cross section having a bottom wall surface 32, an inner wall surface 31 which is erected from an inner peripheral side edge of the bottom wall surface 32, and an outer wall surface 35 which is erected from an outer peripheral side edge of the bottom wall surface 32. More specifically, the inner wall surface 31 of each coupling plate 3 and the outer wall surface of the first plate 11 are brazed to each other, and the bottom wall surface 32 of each coupling plate 3 and the flange portions 123 of the second plate 12 are brazed to each other. The inner wall surface 31, the outer wall surface 35, and the bottom wall surface 32 are illustrated in FIGS. 8 and 9.

Figure 10:
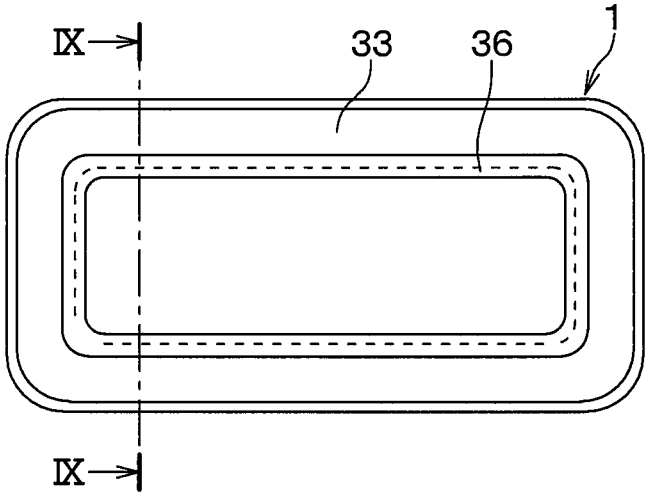
FIG. 10 is a front view of a single coupling plate in the heat exchanger of FIG. 1.

In this example, a shape of a cross section taken along a line IX-IX of the coupling plate 3 illustrated in FIG. 10 is illustrated in FIG. 9. As illustrated in FIGS. 9 and 10, each coupling plate 3 has a locking portion 36 that protrudes from an end portion of the inner wall surface 31 on an opposite side to the bottom wall surface 32 toward the intake flow channel 13. The locking portion 36 is engageable with an end face of the first plate 11 in the first fluid flow direction A. Further, the locking portion 36 is provided over an entire circumference of the inner wall surface 31.

In assembling the first plate 11 and the second plate 12 sandwiching the stacked core 2 to the coupling plate 3, when the first plate 11 intrudes more than necessary into each coupling plate 3, the end face of the first plate 11 is engaged with the locking portion 36. This prevents the first plate 11 from protruding toward an intake pipe 92 of the coupling plate 3.

Figure 4:
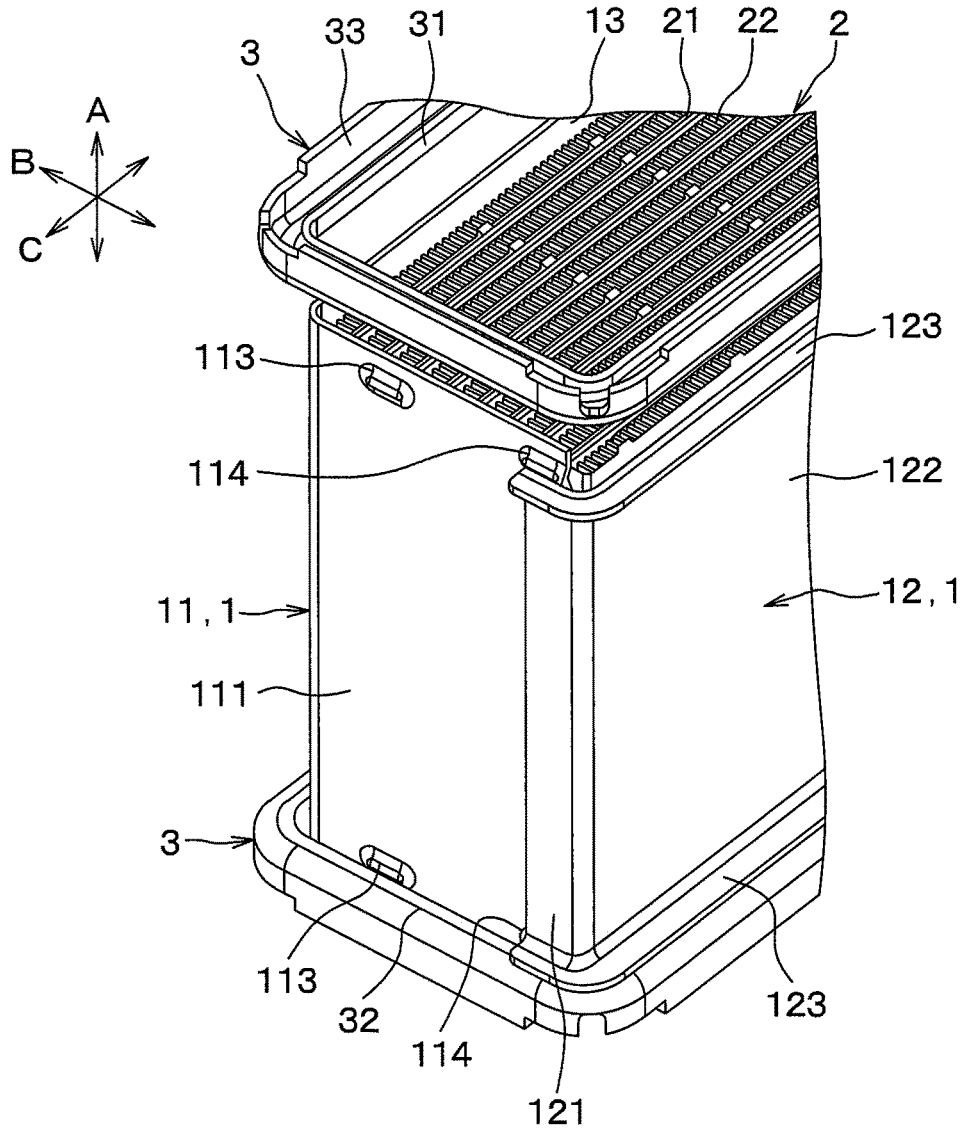
FIG. 4 is an exploded perspective view of the heat exchanger in FIG. 1.
Figure 5:
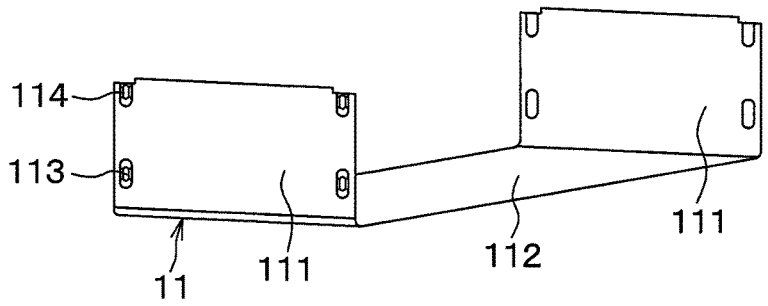
FIG. 5 is a perspective view of a first plate in the heat exchanger in FIG. 1.
Figure 6:
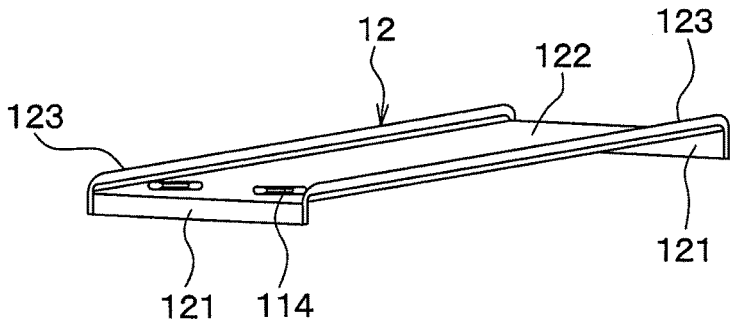
FIG. 6 is a perspective view of a second plate in the heat exchanger in FIG. 1

As illustrated in FIGS. 4 and 5, the first-plate end plate portion 111 is formed with protruding positioning protrusions 113 that contacts the bottom wall surface 32 of each coupling plate 3. Relative positions of the first plate 11 and the coupling plate 3 in the first fluid flow direction A are set by the abutment between the positioning protrusions 113 and the bottom wall surface 32 of the coupling plate 3 when the first plate 11 and the coupling plate 3 are temporarily assembled together.

As illustrated in FIG. 9, after a packing 91 and a skirt portion 921 of the intake pipe 92 through which the intake air flows have been inserted into the groove portion 33 of each coupling plate 3, an outer edge portion 34 of the coupling plate 3 is swaged, to thereby couple the coupling plate 3 and the intake pipe 92 together. The packing 91 may be made of acrylic rubber, fluorine rubber, silicone rubber, or the like. The intake pipe 92 may be made of a metal such as aluminum, a resin, or the like. The groove portion 33 of the coupling plate 3 is formed by press molding. The groove portion 33 is provided with substantially no step, and formed in a substantially plate-like shape. For that reason, a compressibility of the packing 91 can be made substantially uniform, and an excellent sealing performance can be obtained.

As illustrated in FIGS. 4, 5, and 8, sealing protrusions 114 are provided in the first-plate end plate portions 111, and gaps generated in meeting portions between the first-plate end plate portions 111, the second-plate end plate portions 121, and the coupling plate 3 are filled with the respective sealing protrusions 114.

In each of the meeting portions, when a gap defined by a curved portion between the bottom wall surface 32 and the inner wall surface 31 of the coupling plate 3, a curved portion between the second-plate end plate portion 121 and the flange portion 123, and the first-plate end plate portion 111 is large, the intake flow channel 13 may communicate with an external space (that is, an atmosphere) through the gap defined in the meeting portion between the first-plate end plate portion 111, the second-plate end plate portion 121 and the coupling plate 3.

Therefore, in the present embodiment, since the surfaces of the second-plate end plate portion 121 and the coupling plate 3 facing the meeting gap are rounded, the surfaces of the sealing protrusion 114 facing the meeting gap are also rounded so that the meeting gaps are set to be as small as possible.

In manufacturing the heat exchanger, first, the components of the duct 1, the components of the stacked core 2, and the coupling plate 3 are temporarily assembled into a temporary heat exchanger assembly. The duct 1 and the stacked core 2 in the provisionally assembled state are held by a jig not shown or the like so that those components are crimped in the tube stacking direction B. The duct 1 and the coupling plate 3 in the temporarily assembled state are held by a jig not shown so that the outer wall surface of the first plate 11 and the inner wall surfaces 31 of the coupling plates 3 are in close contact with each other.

In the temporarily assembled state, since the bottom wall surface 32 of each coupling plate 3 abuts against the positioning protrusions 113 and the flange portions 123, the coupling plate 3 can be disposed at a predetermined position with respect to the first plate 11 and the second plate 12.

Subsequently, the heat exchanger temporary assembly is heated in a furnace to braze the respective components to each other. At the time of brazing, a dimension of the stacked core 2 in the tube stacking direction B decreases due to melting of a brazing material. The duct 1 is divided into the first plate 11 and the second plate 12, and the first plate 11 and the second plate 12 are movable relative to each other in the tube stacking direction B until the brazing is completed.

In addition, the bottom wall surface 32 of each coupling plate 3 and the surface of each flange portion 123 of the second plate, which are to be brazed to each other, extend in the tube stacking direction B. The coupling plate 3 and the second plate 12 can move relative to each other in the tube stacking direction B until the brazing is completed. In other words, the coupling plate 3 does not disturb the movement of the second plate 12 in the tube stacking direction B.

Therefore, when the dimension of the stacked core 2 in the tube stacking direction B decreases due to the melting of the brazing material at the time of brazing, the second plate 12 moves in the tube stacking direction B following a dimensional change of the stacked core 2. Therefore, the dimension in the tube stacking direction between the first-plate center plate portion 112 and the second-plate center plate portion 122 also changes. As a result, at the time of brazing, a gap is less likely to be generated between the first plate central plate portion 112 and the outer fins 22, between the second-plate center plate portion 122 and the outer fins 22, and between the tubes 21 and the outer fins 22, thereby preventing a brazing failure from occurring.

The bottom wall surface 32 of the coupling plate 3 and the surface of the flange portion 123 of the second plate, which are to be brazed, extend in the tube stacking direction B. Therefore, when the dimension of the stacked core 2 decreases at the time of brazing and the second-plate center plate portion 122 moves to the inside of the duct 1 from the inner wall surface 31 of the coupling plate 3, the flange portion 123 slides inside of the duct 1. Even when the flange portion 123 moves following the movement of the second plate 12 during brazing, the flange portion 123 faces the bottom wall surface 32 of the coupling plate 3, and the second plate 12 and the coupling plate 3 can be brazed to each other. In this manner, not only the duct 1 but also the coupling portion between the duct 1 and the coupling plate 3 can be structured so as to absorb the dimensional change of the stacked core 2 at the time of brazing.

Further, in a state where brazing is completed, gaps generated in the collecting portions of the first-plate end plate portions 111, the second-plate end plate portions 121, and the coupling plates 3 are filled with the respective sealing protrusion portions 114. Therefore, the intake air flowing through the intake flow channel 13 can be prevented from leaking into the external space through the gaps.

Figure 11:
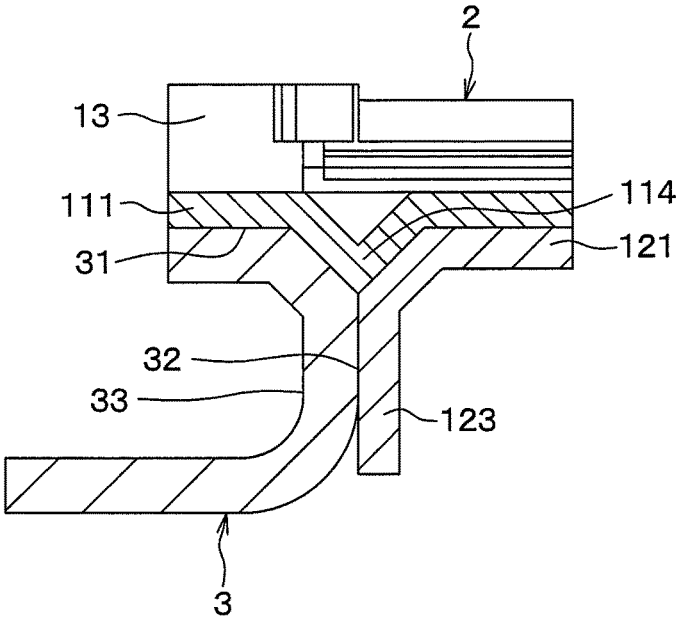
FIG. 11 is a cross-sectional view illustrating a main part of a heat exchanger according to a first modification of the first embodiment.

In the above embodiment, the surfaces of the sealing protrusion portion 114 facing the meeting gap are rounded. However, as in a first modification of the first embodiment illustrated in FIG. 11, the surfaces of the second-plate end plate portion 121 and the coupling plate 3 facing the meeting gap may be chamfered to be flat. In that case, it is desirable that the surfaces of the sealing protrusion portion 114 facing the meeting gap are also formed to be flat so that the meeting gap is as small as possible.

In the above embodiment, the surface of the second-plate end plate portion 121 facing the meeting gap, the surface of the coupling plate 3 facing the meeting gap, and the surfaces of the sealing protrusion portion 114 facing the meeting gap are all rounded. However, as in a second modification of the first embodiment illustrated in FIG. 12, the surfaces of the second-plate end plate portion 121 and the coupling plate 3 facing the meeting gap may be rounded, and the surfaces of the sealing protrusion portion 114 facing the meeting gap may be flat.

As described above, when the surfaces of the sealing protrusion portion 114 facing the meeting gap are formed to be flat, it is easier to mold the sealing protrusion portion 114 than that in the case where those surfaces are rounded.

Figure 12:
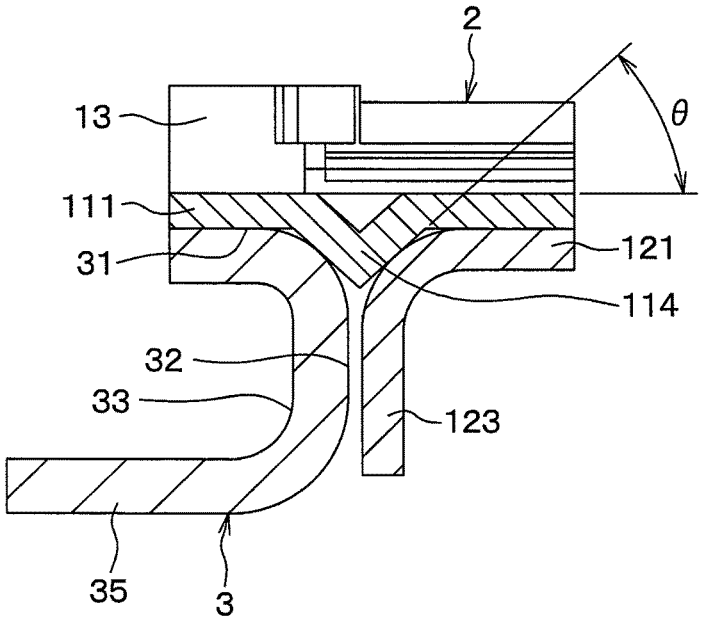
FIG. 12 is a cross-sectional view illustrating a main part of a heat exchanger according to a second modification of the first embodiment.

In the second modification of the first embodiment illustrated in FIG. 12, the rounded surfaces of the second-plate end plate portion 121 and the coupling plate 3 facing the meeting gap are brought into contact with the flat surfaces of the sealing protrusion portion 114. In this case, a gap is defined between the bottom wall surface 32 of the coupling plate 3 and the flange portion 123 of the second plate 12.

Further, in the second modification of the first embodiment illustrated in FIG. 12, an angle 0 of the surface of the sealing protrusion portion 114 facing the meeting gap with respect to the first-plate end plate portion 111 is set to 45 degrees or more, thereby being capable of reducing the meeting gap.

In the above embodiment, the surface of the second-plate end plate portion 121 facing the meeting gap, the surface of the coupling plates 3 facing the meeting gap, and the surfaces of the sealing protrusion portion 114 facing the meeting gap are all rounded. However, as in a third modification of the first embodiment illustrated in FIG. 13, the surfaces of the second-plate end plate portion 121 and the coupling plate 3 facing the meeting gap may be flat, and the surfaces of the sealing protrusion portion 114 facing the meeting gap may be rounded.

Figure 13:
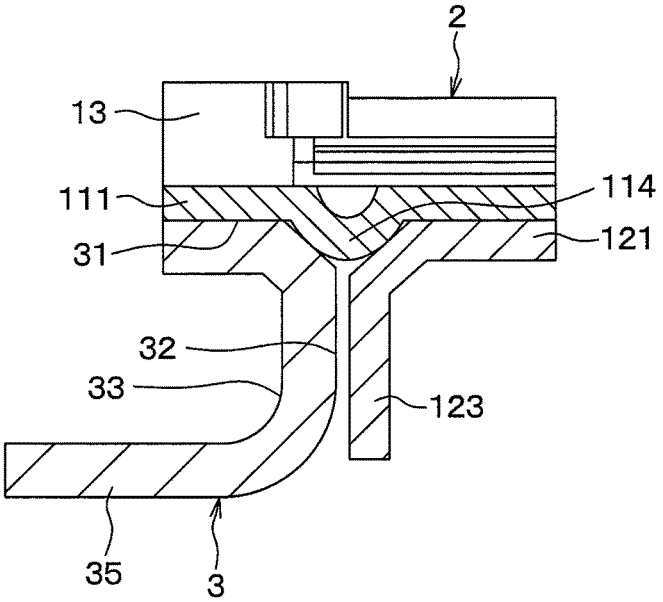
FIG. 13 is a cross-sectional view illustrating a main part of a heat exchanger according to a third modification of the first embodiment.

In the third modification of the first embodiment illustrated in FIG. 13, the flat surfaces of the second-plate end plate portion 121 and the coupling plate 3 facing the meeting gap are brought into contact with the rounded surfaces of the sealing protrusion portion 114. In this case, a gap is defined between the bottom wall surface 32 of the coupling plate 3 and the flange portion 123 of the second plate 12.

Figure 14:
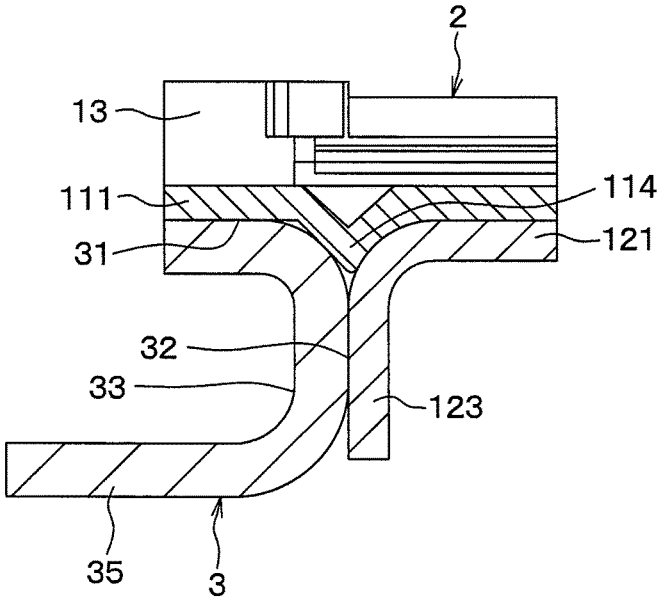
FIG. 14 is a cross-sectional view illustrating a main part of a heat exchanger according to a fourth modification of the first embodiment.

In the above embodiment, the surface of the second-plate end plate portion 121 facing the meeting gap, the surface of the coupling plates 3 facing the meeting gap, and the surfaces of the sealing protrusion portions 114 facing the meeting gap are all rounded. However, as in a fourth modification of the first embodiment illustrated in FIG. 14, the surfaces of the second-plate end plate portion 121 and the coupling plate 3 facing the meeting gap may be rounded. On the other hand, one of the surfaces of the sealing protrusion portion 114 facing the meeting gap, which is facing the second-plate end plate portion 121, may be rounded, and another surface facing the coupling plate 3 may be flat.

In this case, after the rounded surface of the second-plate end plate portion 121 facing the meeting gap is joined to the rounded surface of the sealing protrusion portion 114, the rounded surface of the coupling plate 3 facing the meeting gap may be joined to the flat surface of the sealing protrusion portion 114.

Figure 15:
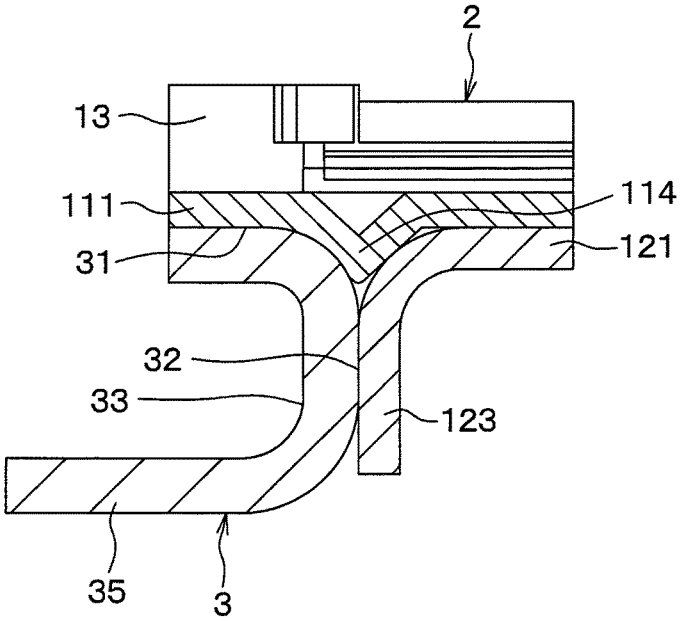
FIG. 15 is a cross-sectional view illustrating a main part of a heat exchanger according to a fifth modification of the first embodiment.

In the above embodiment, the surface of the second-plate end plate portion 121 facing the meeting gap, the surface of the coupling plate 3 facing the meeting gap, and the surfaces of the sealing protrusion portions 114 facing the meeting gap are all rounded. However, as in a fifth modification of the first embodiment illustrated in FIG. 15, the surfaces of the second-plate end plate portion 121 and the coupling plate 3 facing the meeting gap may be rounded. On the other hand, one of the surfaces of the sealing protrusion portion 114 facing the meeting gap, which is facing the second-plate end plate portion 121, may be flat, and another surface facing the coupling plate 3 may be rounded.

In this case, after the rounded surface of the coupling plate 3 facing the meeting gap is joined to the rounded surface of the sealing protrusion portion 114, the rounded surface of the second-plate end plate portion 121 facing the meeting gap may be joined to the flat surface of the sealing protrusion portion 114.

Further, in the embodiment and the modifications described above, when the surface of the sealing protrusion portion 114 facing the meeting gap are flat, a base of the sealing protrusion portion 114 may include a rounded shape.

Figure 16:
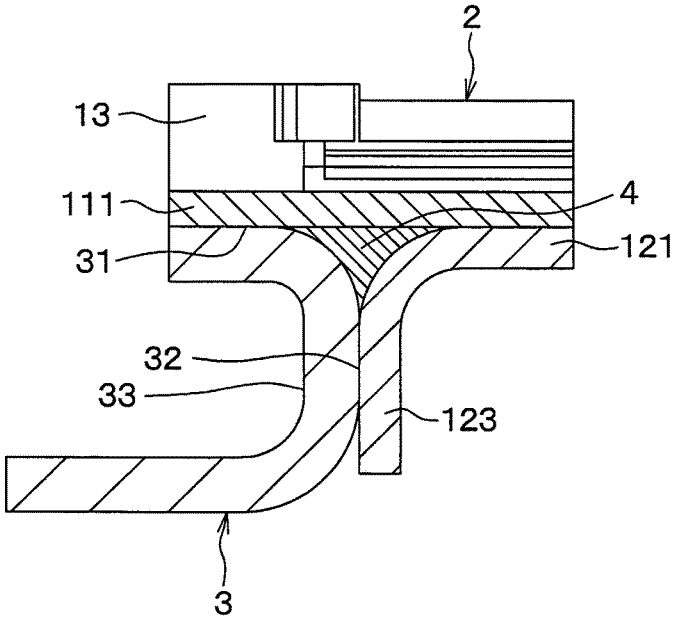
FIG. 16 is a cross-sectional view illustrating a main part of a heat exchanger according to a sixth modification of the first embodiment.

In addition, in the embodiment described above, the sealing protrusion portion 114 is formed integrally with the first-plate end plate portion 111, but as in a sixth modification of the first embodiment illustrated in FIG. 16, a sealing member 4 as another member may be inserted into each meeting gap so as to fill the meeting gap.

Figure 17:
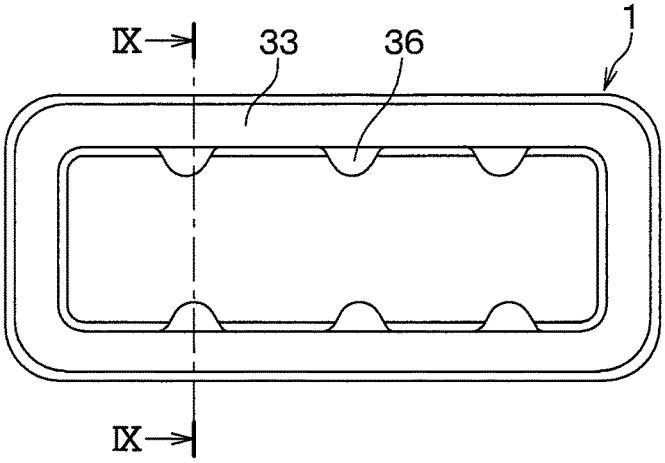
FIG. 17 is a front view illustrating a single coupling plate of a heat exchanger according to a seventh modification of the first embodiment.

Although the locking portion 36 of the first plate 11 is provided over the entire circumference of the inner wall surface 31 in the above embodiment, as in a seventh modification of the first embodiment illustrated in FIG. 17, the locking portion 36 may be provided on a part of an inner peripheral portion of the inner wall surface 31. In the seventh modification, six locking portions 36 are provided, but at least one locking portion 36 may be provided. A shape of a cross-section taken along a line IX-IX of the coupling plate 3 illustrated in FIG. 17 is illustrated in FIG. 9.

Figure 18:
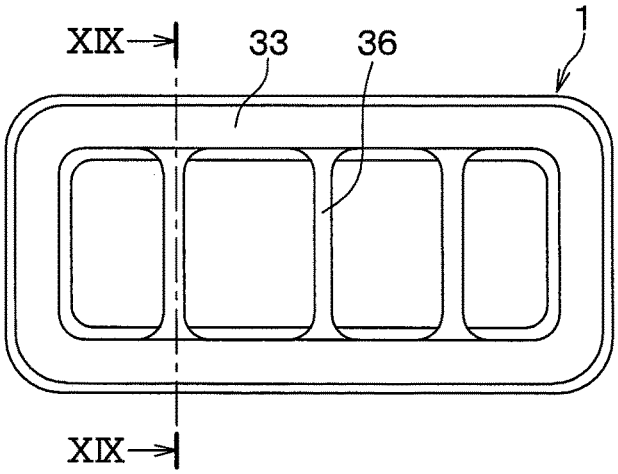
FIG. 18 is a front view illustrating a single coupling plate of a heat exchanger according to an eighth modification of the first embodiment.
Figure 19:
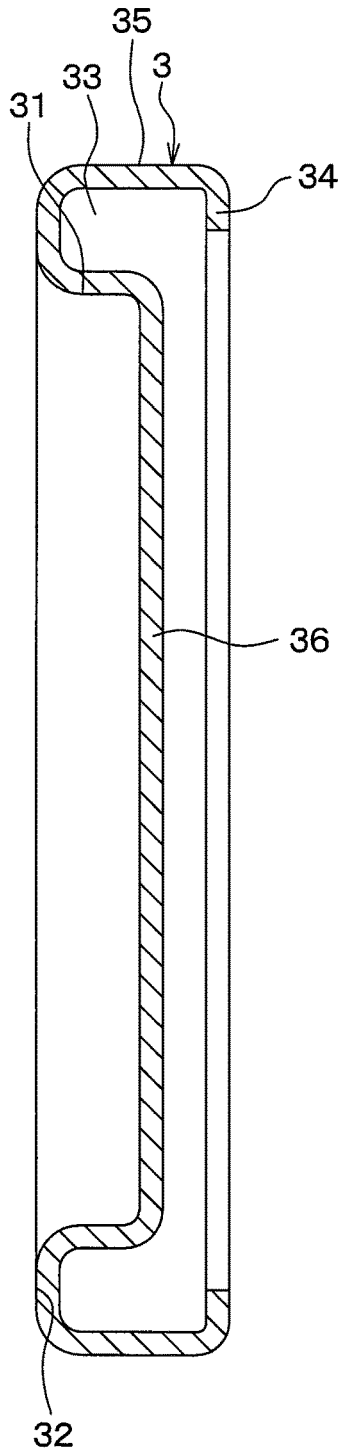
FIG. 19 is a cross-sectional view taken along a line XIX-XIX in FIG. 18.

Although the locking portion 36 of the first plate 11 is provided over the entire circumference of the inner wall surface 31 in the above embodiment, as in an eighth modification of the first embodiment illustrated in FIGS. 18 and 19, the locking portion 36 may be configured to connect facing parts of the inner wall surface 31 to each other. More specifically, the locking portion 36 connects portions of the inner wall surface 31, which face each other in the tube stacking direction B, to each other.

Further, in the above embodiment, the inner fins are disposed in the tubes 21, but no inner fins may be provided.

In the above embodiment, the single first plate 11 having the first-plate end plate portions 111 and the first-plate center plate portion 112 formed integrally with each other is used. Alternatively, the first plate 11 may be configured by three plates including the first-plate end plate portions 111 and the first-plate center plate portion 112 which are formed, separately.

Second Embodiment

Figure 20:
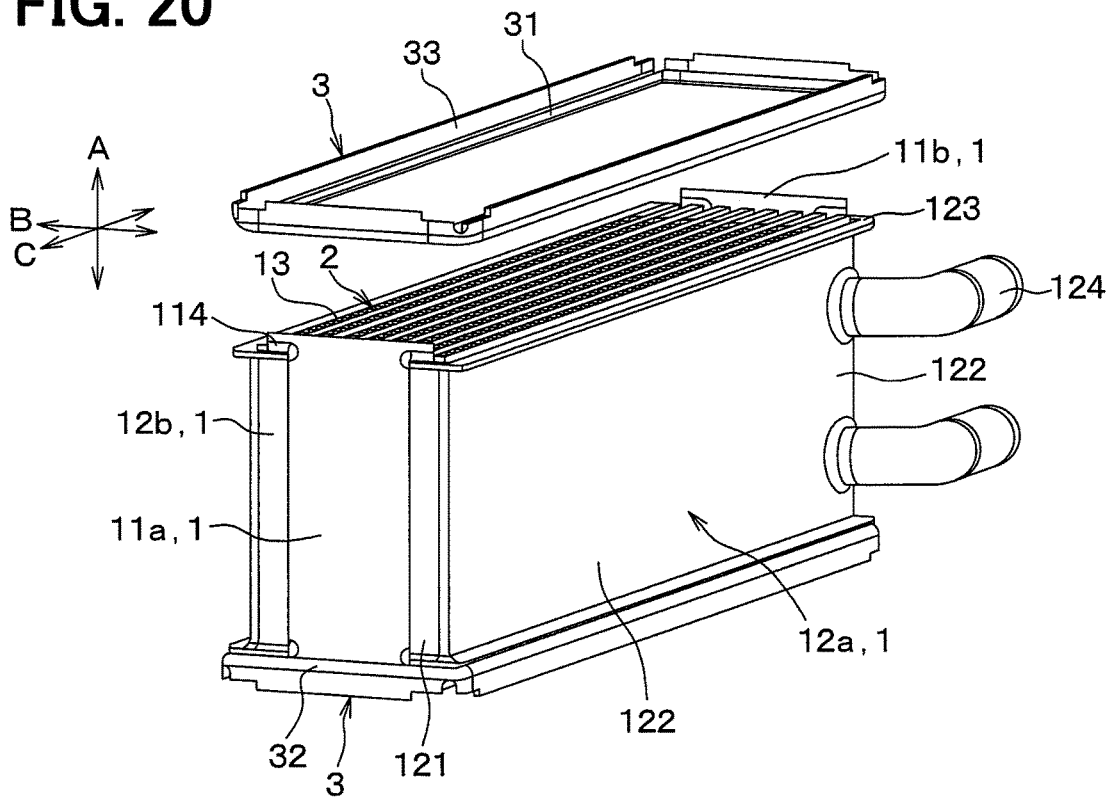
FIG. 20 is an exploded perspective view of a heat exchanger according to a second embodiment.
Figure 21:
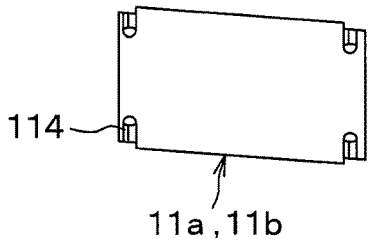
FIG. 21 is a perspective view of a first plate in the heat exchanger in FIG. 20.
Figure 22:
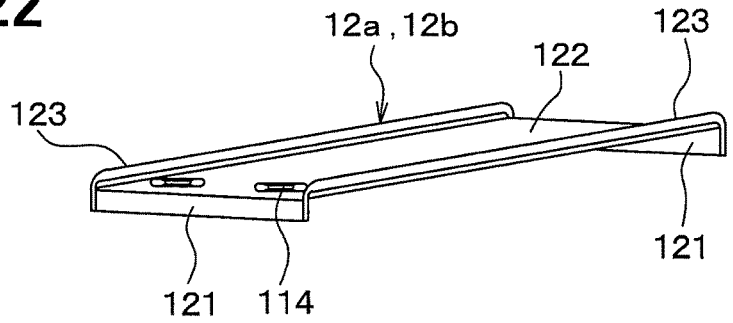
FIG. 22 is a perspective view of a second plate in the heat exchanger in FIG. 20.

A second embodiment will be described. Only parts difference from those in the first embodiment will be described. As illustrated in FIGS. 20 to 22, the duct 1 includes two first plates 11*a*, 11*b* and two second plates 12*a*, 12*b*.

One first plate 11*a* is formed of a flat plate and is disposed to face one end face of a stacked core 2 in a core width direction C. Further, in the one first plate 11*a*, the positioning projections 113 are eliminated and four sealing protrusion portions 114 are formed.

The other first plate 11*b* is disposed to face the other end face of the stacked core 2 in the core width direction C and has the same shape as that of the first plate 11*a*.

One second plate 12*a* includes second-plate end plate portions 121, a second-plate center plate portion 122, and flange portions 123. The second-plate end plate portions 121 are disposed to face the end face of the stacked core 2 in the core width direction C and overlap partial regions of the two first plates 11*a* and 11*b* in the core width direction C, and are brazed to the outer wall surfaces of the two first plates 11*a* and 11*b*. The second-plate center plate portion 122 is disposed to face one end face of the stacked core 2 in the tube stacking direction B, connects the second-plate end plate portions 121 to each other, and is brazed to the other end face of the stacked core 2. The flange portions 123 extend toward an outside that is a side opposite to an intake flow channel 13 from both end portions of the second plates 12 in a first fluid flow direction A. Surfaces of the flange portions 123 facing the coupling plates 3 are perpendicular to the first fluid flow direction A.

The other second plate 12*b* is disposed to face the other end face of the stacked core 2 in the tube stacking direction B, and has the same structure as that of the one second plate 12*a*. Each of the flange portions 123 formed in the second plates 12*a* and 12*b* has a surface extending in the tube stacking direction B when assembled to the stacked core 2, the first plates 11*a*, 11*b*, and the coupling plate 3. In the present embodiment, the tube stacking direction B is a direction perpendicular to the first fluid flow direction A.

The two first plates 11*a*, 11*b* and the two second plates 12*a*, 12*b* are combined together to provide the intake flow channel 13. A shape of the intake flow channel 13 when viewed along the first fluid flow direction A is substantially rectangular.

Each of the coupling plates 3 is brazed to each end portion of the duct 1. More specifically, the inner wall surface 31 of each coupling plate 3 and the outer wall surfaces of the two first plates 11*a* and 11*b* are brazed to each other, and the bottom wall surface 32 of each coupling plate 3 and the flange portions 123 are brazed to each other.

As in the first embodiment described above, after the components of the duct 1, the components of the stacked core 2, and the coupling plates 3 have been assembled together, the assembled components are heated in a brazing furnace, and the respective components are brazed to each other.

The duct 1 is divided into the two first plates 11*a*, 11*b*, and the two second plates 12*a*, 12*b*, and the two first plates 11*a*, 11*b*, and the two second plates 12*a*, 12*b* are movable relative to each other in the tube stacking direction B until the brazing is completed.

The bottom wall surface 32 of each coupling plate 3 and the flange portions 123 of the two second plates 12*a*, 12*b*, which are to be brazed, each have a surface extending in the tube stacking direction B. Therefore, the coupling plates 3 and the two second plates 12*a*, 12*b* are movable relative to each other in the tube stacking direction B until the brazing is completed. In other words, the coupling plate 3 does not disturb the movement of the two second plates 12*a* and 12*b* in the tube stacking direction B.

Therefore, when the dimension of the stacked core 2 in the tube stacking direction B decreases due to the melting of the brazing material at the time of brazing, the two second plates 12*a* and 12*b* move in the tube stacking direction B following a dimensional change of the stacked core 2. As a result, a dimension in the tube stacking direction between the second-plate center plate portion 122 of the one second plate 12*a* and the second-plate center plate portion 122 of the other second plate 12*b* also changes.

As a result, at the time of brazing, a gap is less likely to be generated between the second-plate center plate portion 122 of one second plate 12*a* and the outer fins 22, between the second-plate center plate portion 122 of the other second plate 12*b* and the outer fins 22, and between the tubes 21 and the outer fins 22, thereby preventing a brazing failure from occurring.

In addition, when the dimension of the stacked core 2 in the tube stacking direction B decreases at the time of brazing and the second-plate center plate portion 122 moves to the inside of the duct 1 from the inner wall surface 31 of the coupling plate 3, the flange portion 123 slides inside of the duct 1. There is a case that the flange portions 123 move following the movement of the two second plates 12*a* and 12*b* at the time of brazing. Even in that case, since the flange portions 123 face the bottom wall surfaces 32 of the coupling plates 3, the two second plates 12*a* and 12*b* are brazed to the bottom wall surface 32 of the coupling plate 3 by the flange portion 123. Similarly, in the present embodiment, not only the duct 1 but also the coupling portion between the duct 1 and the coupling plate 3 can be structured so as to absorb the dimensional change of the stacked core 2 at the time of brazing.

Further, in a state where brazing is completed, since all of the four gaps are filled with the sealing protrusion portions 114, the intake air flowing through the intake flow channel 13 can be prevented from leaking into the external space through those gaps. One of the four gaps is a gap generated in a collecting portion of the one second plate 12*a*, the one first plate 11*a*, and each coupling plate 3. Another of the four gaps is a gap generated in a collecting portion of the one second plate 12*a*, the other first plate 11*b*, and each coupling plate 3. Another of the four gaps is a gap generated in a collecting portion of the other second plate 12*b*, the one first plate 11*a*, and each coupling plate 3. Another of the four gaps is a gap generated in a collecting portion of the other second plate 12*b*, the other first plate 11*b*, and each coupling plate 3.

Further, in order to cope with a heat exchanger of multiple types different in the dimension of the stacked core 2 in the tube stacking direction B, the dimensions of the two first plates 11*a* and 11*b* in the tube stacking direction B are changed.

Third Embodiment

Figure 23:
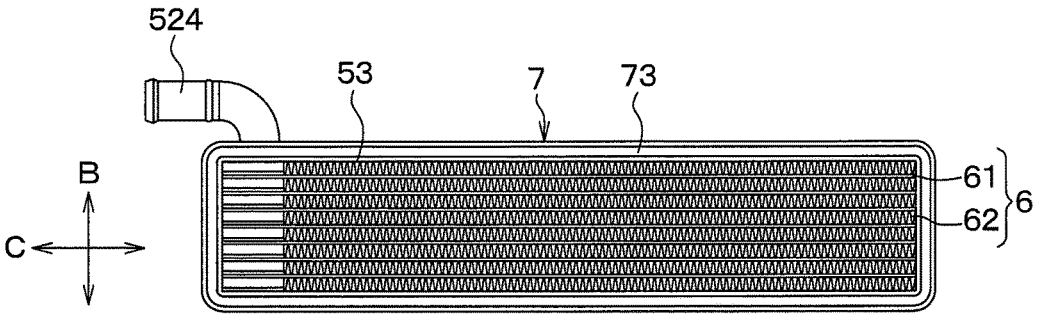
FIG. 23 is a front view of a heat exchanger according to a third embodiment.
Figure 24:
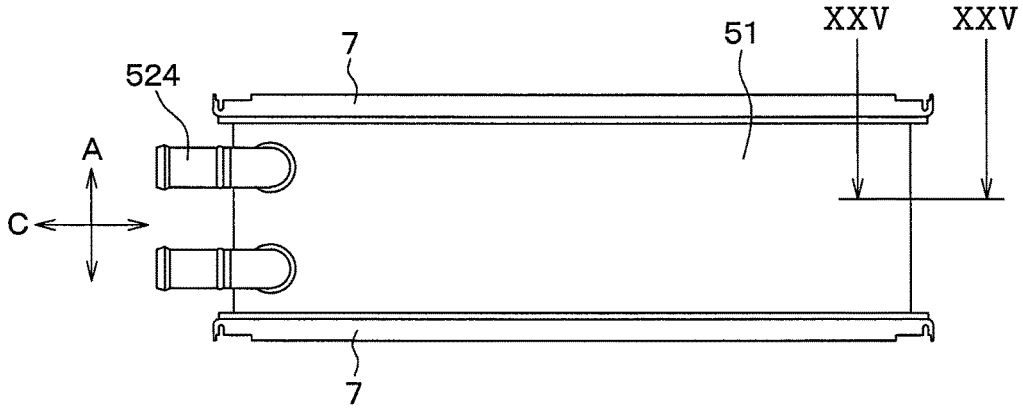
FIG. 24 is a top view of the heat exchanger in FIG. 23.
Figure 25:
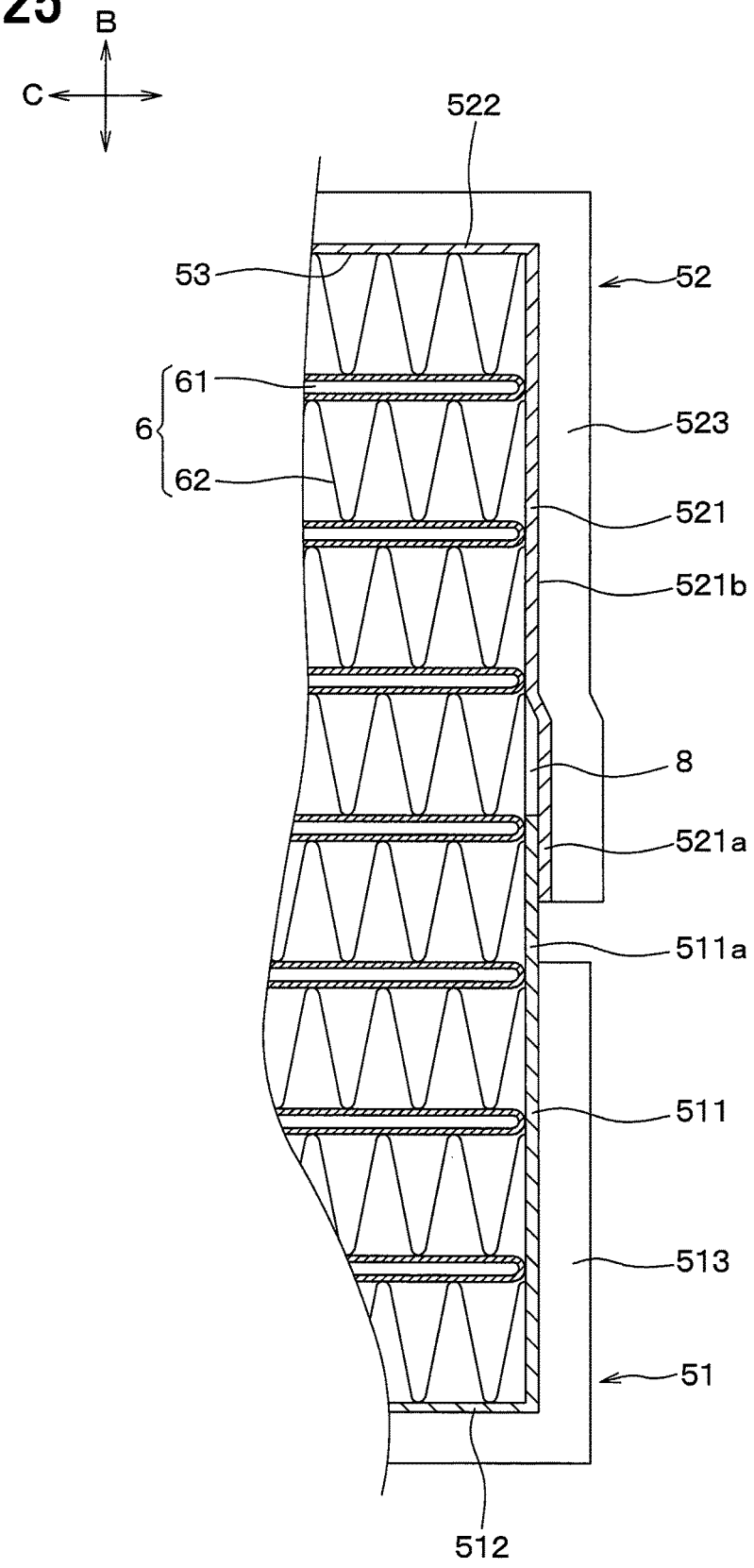
FIG. 25 is a cross-sectional view taken along a line XXV-XXV in FIG. 24.
Figure 26:
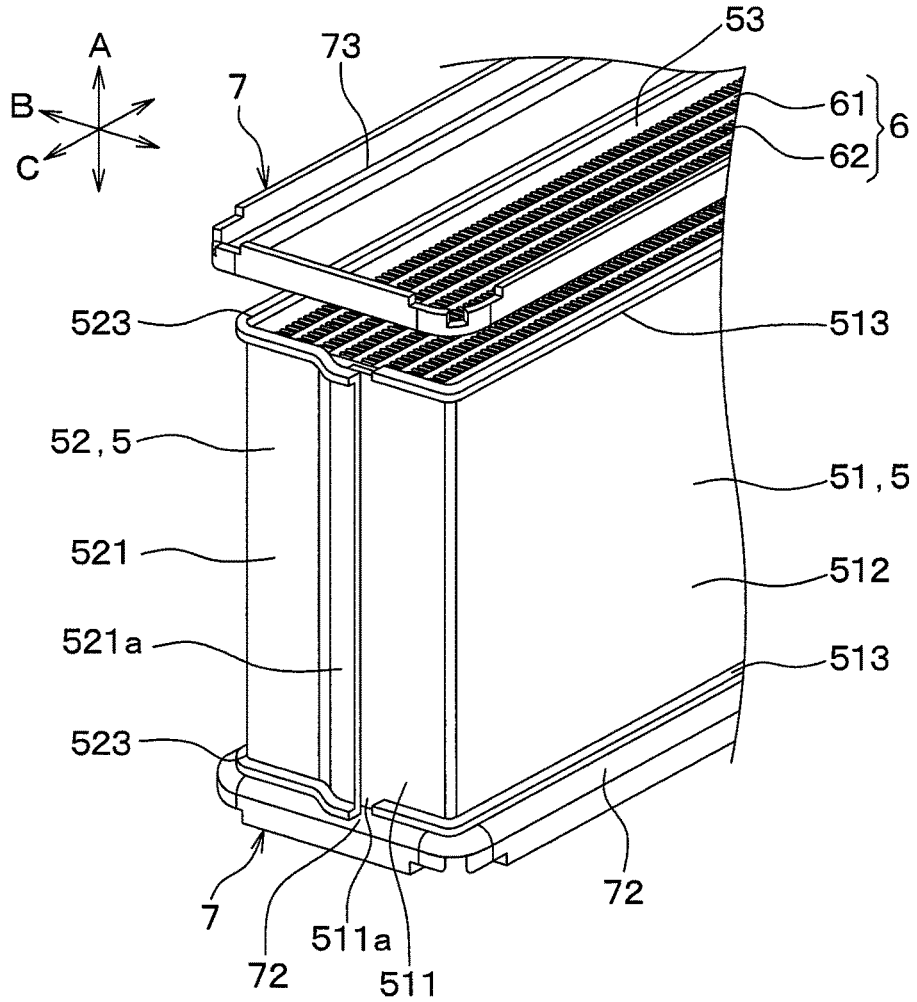
FIG. 26 is an exploded perspective view of the heat exchanger in FIG. 23.
Figure 27:
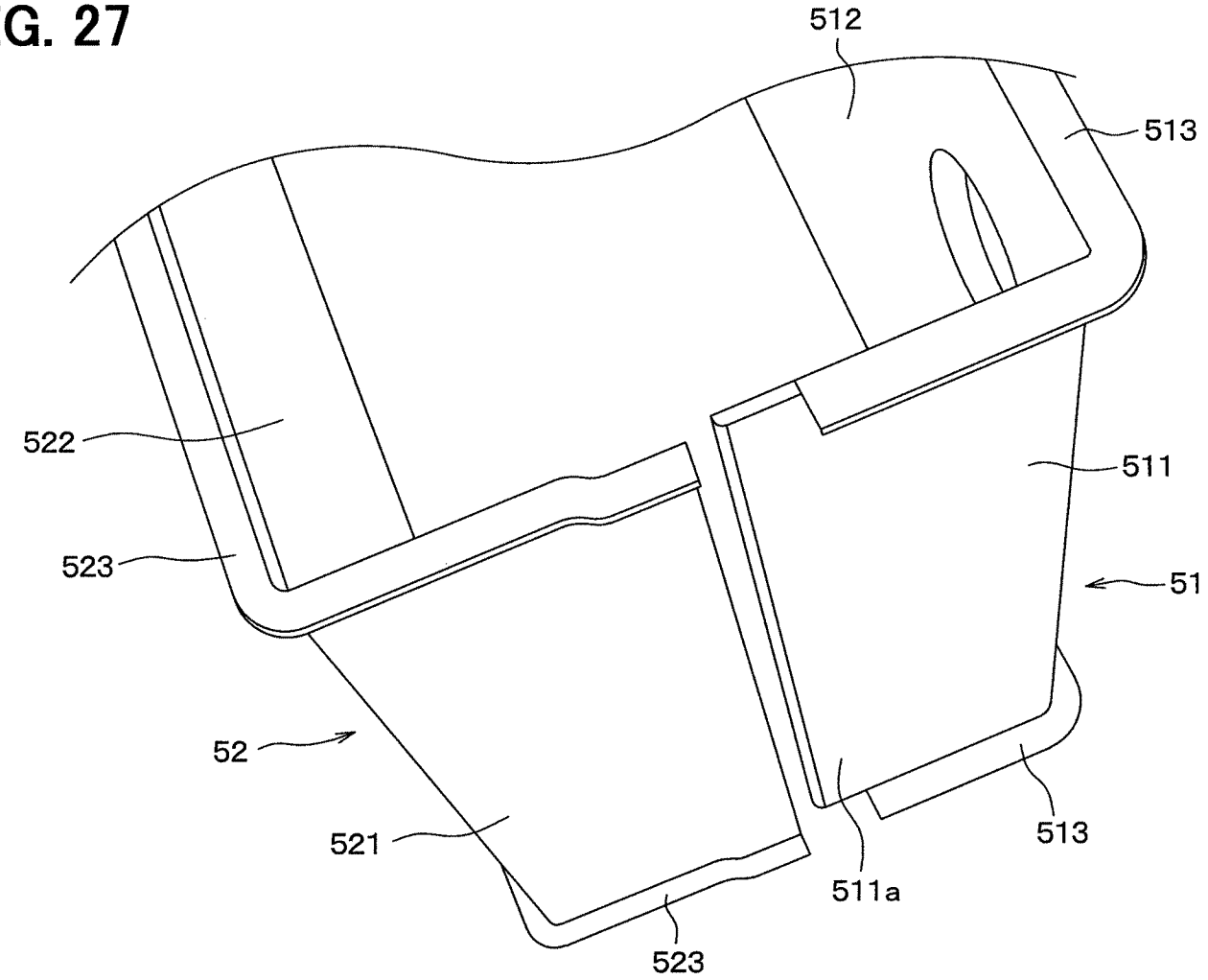
FIG. 27 is an exploded perspective view of a first plate and a second plate in the heat exchanger in FIG. 23.
Figure 28:
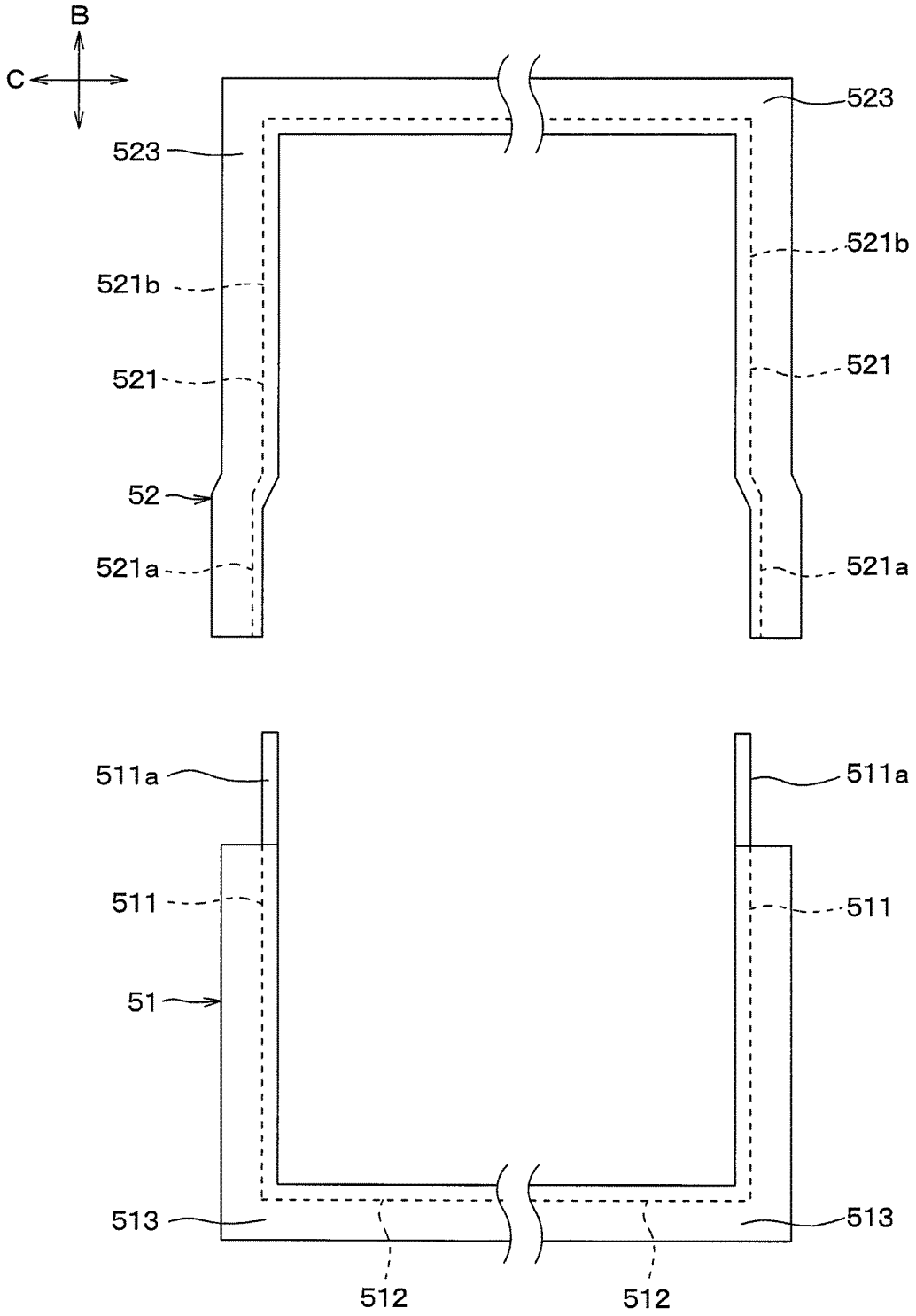
FIG. 28 is an exploded front view of the first plate and the second plate in the heat exchanger in FIG. 23.

A third embodiment will be described. As illustrated in FIGS. 23, 24, and 26, the heat exchanger includes a tubular duct 5 through which an intake air as a first fluid flows, a stacked core 6 that is accommodated in the duct 5, and coupling plates 7 that are brazed to both end portions of the duct 5 as main components.

Figure 29:
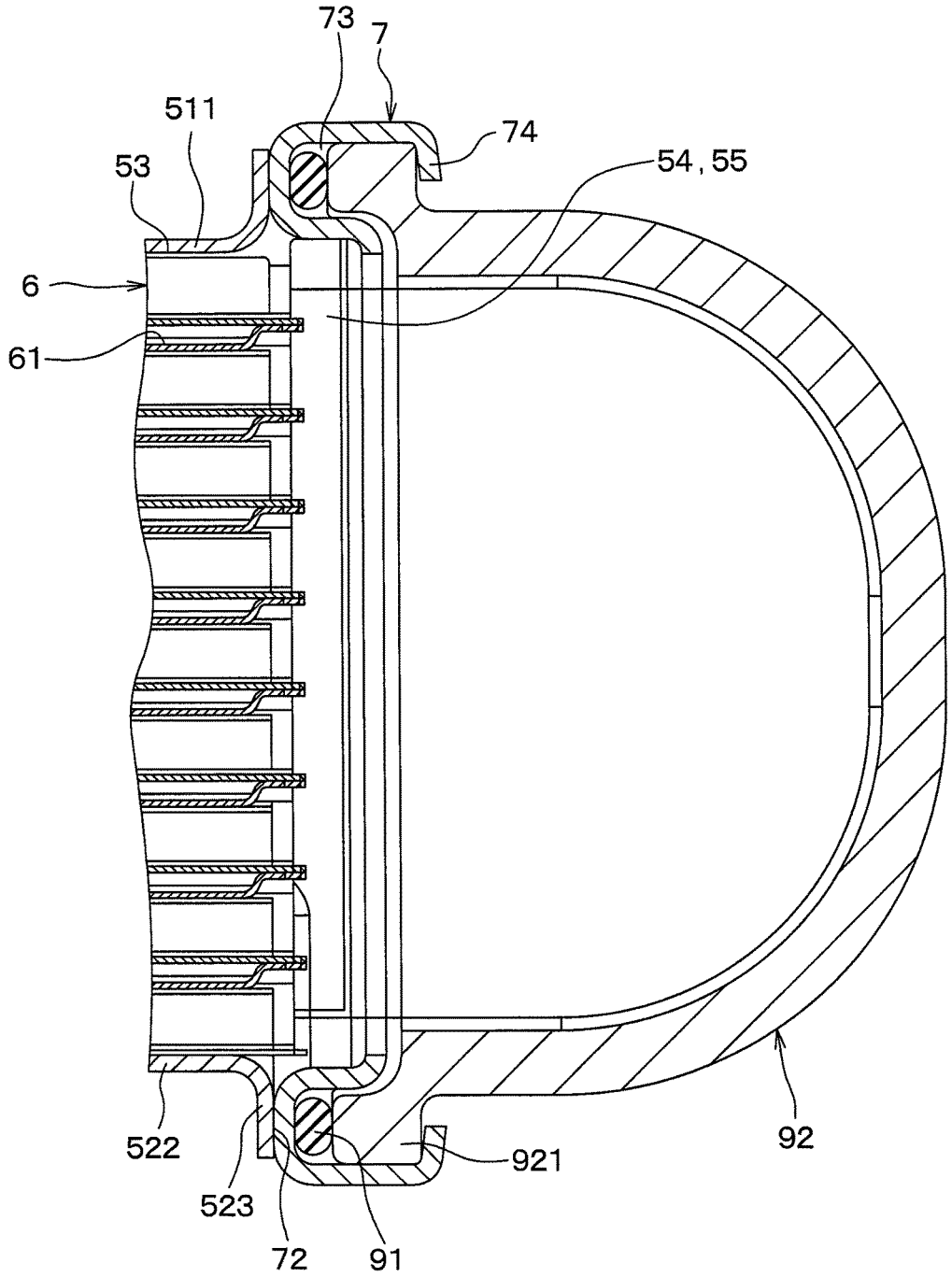
FIG. 29 is a cross-sectional view illustrating a coupling portion of the heat exchanger and an external piping member according to the third embodiment.

As illustrated in FIGS. 23 to 28, the duct 5 includes a first plate 51 and a second plate 52 formed by press molding a metal thin plate made of aluminum or the like in a predetermined shape, and an intake flow channel 53 through which an intake air flows is provided inside of the duct 1. The intake air flows into the intake flow channel 53 from an inflow port 54 on one end side of the duct 5, flows in the intake flow channel 53, and flows out from an outflow port 55 on the other end side of the duct 5 to the outside. The inflow port 54 and the outflow port 55 are illustrated in FIG. 29.

In the stacked core 6, a large number of tubes 61 having a flat shape in which a flow channel through which a cooling fluid as a second fluid flows is provided are arranged. The tubes 61 may be formed by overlapping the periphery of two plates. Inner fins not shown that promote a heat exchange with an increase in a heat transfer area are arranged within the tubes 61.

The intake air passes between adjacent tubes 61, and outer fins 62 are arranged between the adjacent tubes 61 for the purpose of increasing the heat transfer area to promote the heat exchange. The outer fins 62 are each formed by corrugating a metal thin plate made of aluminum or the like, and are joined to the tubes 61 by brazing. Incidentally, a shape of the stacked core 6 is substantially rectangular.

Hereinafter, a flow direction of the intake air in the duct 5 is referred to as a first fluid flow direction A. Further, a staking direction of the tubes 61 is referred to as a tube stacking direction B. Further, a direction perpendicular to the first fluid flow direction A and the tube stacking direction B is referred to as a core width direction C.

The first plate 51 includes first-plate both end plate portions 511, a first-plate center plate portion 512, and first plate flange portions 513.

The first-plate both end plate portions 511 are disposed to face both end faces of the stacked core 6 in the core width direction C, and are brazed to the end faces of the stacked core 6.

The first-plate center plate portion 512 is disposed to face one end face of the stacked core 6 in the tube stacking direction B, connects the first-plate both end plate portions 511 to each other, and is brazed to the end face of the stacked core 6.

The first plate flange portions 513 extend toward an outside that is a side opposite to the intake flow channel 53 from both end portions of the first plate 51 in the first fluid flow direction A, and surfaces of the first plate flange portions 513 facing the coupling plates 7 are perpendicular to the first fluid flow direction A.

A portion 511*a* of each first-plate both end plate portion 511 on a side opposite to the first plate central plate portion 512 extends along the tube stacking direction B than each first plate flange portion 513 and far from the first-plate center plate portion 512. Hereinafter, each portion 511a is referred to as an overlapping plate portion 511*a*.

The second plate 52 includes second-plate both end plate portions 521, a second-plate center plate portion 522, and second plate flange portions 523.

The second-plate both end plate portions 521 are disposed to face both end faces of the stacked core 6 in the core width direction C.

The second-plate center plate portion 522 is disposed to face the other end face of the stacked core 6 in the tube stacking direction B, connects the second-plate both end plate portions 521 to each other, and is brazed to the end face of the stacked core 6.

The second plate flange portions 523 extend outward in a direction away from the intake flow channel 53 from both end portions of the second plate 52 in the first fluid flow direction A, and have surfaces facing the coupling plates 7 and being perpendicular to the first fluid flow direction A.

A portion 521*a* of each second-plate both end plate portion 521 on a side opposite to the second-plate center plate portion 522 spreads outward in a direction away from the intake flow channel 53, with respect to the portion 521*b* of each second-plate both end plate portion 521 adjacent to the second-plate center plate portion 522. Hereinafter, the portion 521*a* is referred to as a relief plate portion 521*a*.

The respective overlapping plate portions 511*a* are disposed in the gap 8 between both end faces of the stacked core 6 in the core width direction C and the relief plate portions 521*a*, each of the overlapping plate portions 511*a* and the corresponding relief plate portion 521*a* overlap with each other in the core width direction C, and are brazed to each other at the overlapping portion. In addition, the portions 521*a* of the second-plate both end plate portions 521 not overlapping with the first-plate both end plate portions 511 are brazed to the end face of the stacked core 6.

The first plate 51 includes pipes 524 to which piping not shown through which a cooling fluid flows is connected. An external heat exchanger not shown which cools the cooling fluid and the heat exchanger of the present embodiment are connected to each other by the piping.

The first plate 51 and the second plate 52 are combined together to provide the intake flow channel 53. A shape of the intake flow channel 53 when viewed along the first fluid flow direction A is substantially rectangular.

Each coupling plate 7 is formed in a substantially rectangular frame shape by press molding a metal thin plate made of aluminum or the like, and is brazed to both end portions of the duct 5 so as to surround the inflow port 54 or the outflow port 55.

More specifically, bottom wall surfaces 72 of the coupling plate 7 perpendicular to the first fluid flow direction A are brazed to the first plate flange portions 513 and second plate flange portions 523. The bottom wall surfaces 72 are illustrated in FIG. 29.

As illustrated in FIG. 29, each of the coupling plates 7 is provided with a groove portion 73 having a U-shaped cross section. After a packing 91 and a skirt portion 921 of the intake pipe 92 through which the intake air flows have been inserted into the groove portion 73, an outer edge portion 74 of the coupling plate 7 is swaged, to thereby couple the coupling plate 7 and the intake pipe 92 together. The packing 91 may be made of acrylic rubber, fluorine rubber, silicone rubber, or the like. The intake pipe 92 may be made of a metal such as aluminum, a resin, or the like.

In manufacturing the heat exchanger, first, the components of the duct 5, the components of the stacked core 6, and the coupling plate 7 are temporarily assembled into a temporary heat exchanger assembly. The duct 5 and the stacked core 6 in the provisionally assembled state are held by a jig not shown so that those components are crimped in the tube stacking direction B. The duct 5 and the coupling plates 7 in the temporarily assembled state are held by a jig not shown so that the bottom wall surfaces 72 are in close contact with the first plate flange portions 513 and the second plate flange portions 523.

Subsequently, the heat exchanger temporary assembly is heated in a furnace to braze the respective components to each other. At the time of brazing, a dimension of the stacked core 6 in the tube stacking direction B decreases due to melting of a brazing filler metal.

The duct 5 is divided into the first plate 51 and the second plate 52, and the first plate 51 and the second plate 52 are movable relative to each other in the tube stacking direction B until the brazing is completed.

In addition, the respective surfaces of the bottom wall surfaces 72, the first plate flange portions 513, and the second plate flange portions 523 are perpendicular to the first fluid flow direction A. Therefore, the coupling plate 7, the first plate 51, and the second plate 52 are movable relative to each other in the tube stacking direction B until the brazing is completed. In other words, the coupling plate 7 does not disturb the movement of the first plate 51 and the second plate 52 in the tube stacking direction B.

Therefore, when the dimension of the stacked core 6 in the tube stacking direction B decreases due to the melting of the brazing filler material at the time of brazing, the first plate 51 and the second plate 52 move in the tube stacking direction B following a dimensional change of the stacked core 6. In other words, a relative position of each overlapping plate portion 511a and the corresponding relief plate portion 521*a* in the tube stacking direction B changes, and a dimension in the tube stacking direction between the first-plate center plate portion 512 and the second-plate center plate portion 522 also changes.

As a result, at the time of brazing, a gap is less likely to be generated between the first plate central plate portion 512 and the outer fins 62, between the second-plate center plate portion 522 and the outer fins 62, and between the tubes 61 and the outer fins 62, thereby preventing a brazing failure from occurring.

Figure 30:
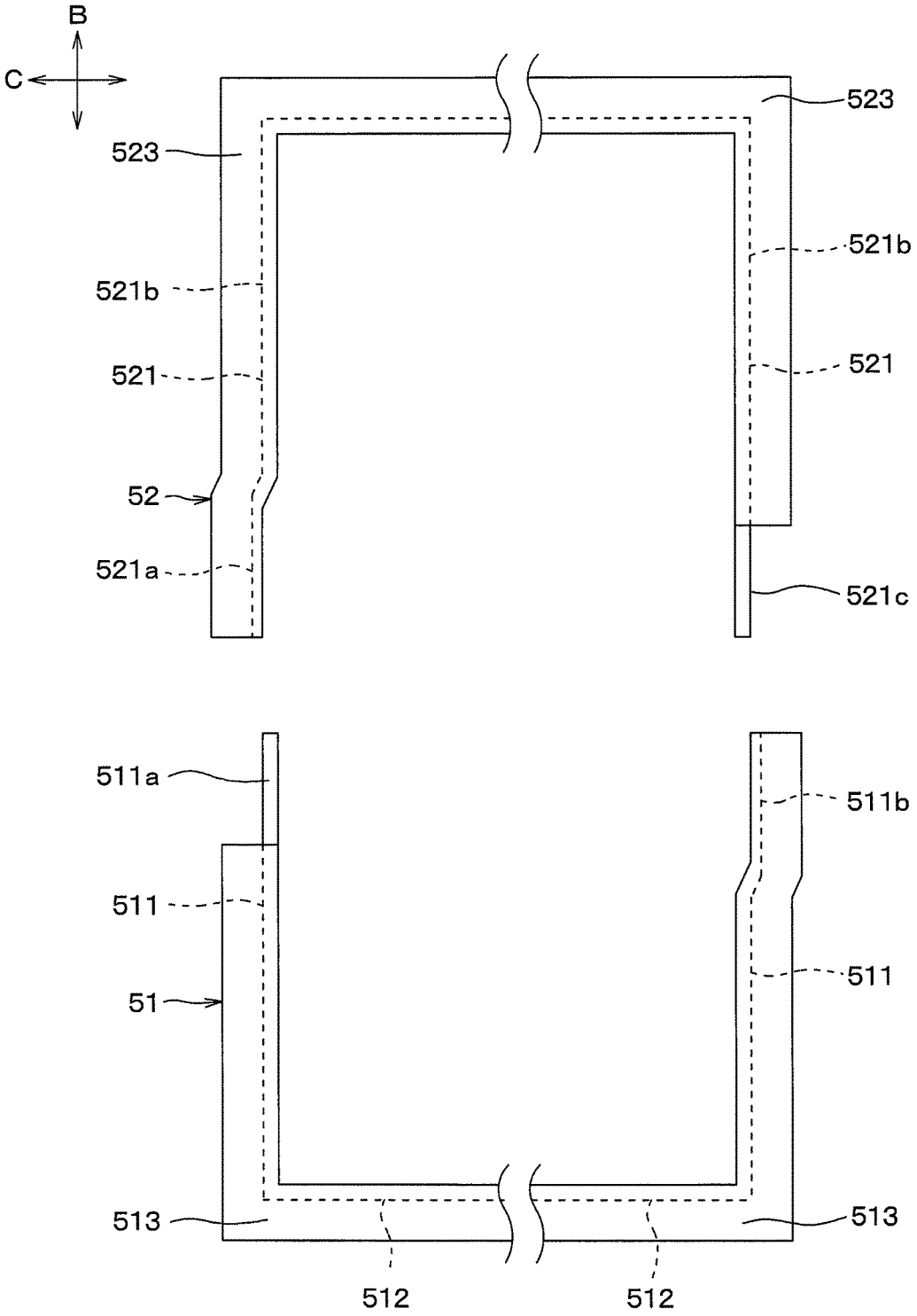
FIG. 30 is an exploded front view of a first plate and a second plate in a heat exchanger according to a modification of the third embodiment.

In the third embodiment, the two overlapping plate portions 511*a* are provided on the first plate 51 and the two relief plate portions 521*a* are provided on the second plate 52. Alternatively, as in a modification of the third embodiment illustrated in FIG. 30, one overlapping plate portion 511*a* and one relief plate portion 511*b* may be provided on the first plate 51, and one relief plate portion 521*a* and one overlapping plate portion 521*c* may be provided on the second plate 52. According to the above configuration, the first plate 51 and the second plate 52 can be made common.

Further, in the above embodiment, the inner fins are disposed in the tubes 61, but no inner fins may be provided.

Other Embodiments

In each of the above embodiments, an example in which the heat exchanger is used as an intercooler has been described, but the heat exchanger may be used other than the intercooler. It should be noted that the present disclosure is not limited to the embodiments described above, and can be appropriately modified.

What is claimed is:

1. A heat exchanger, comprising:

a duct including at least two plates combined into a tubular shape, a first fluid flow channel provided inside the through which a first fluid passes in a first fluid flow direction, an inflow port for the first fluid on one end of the first fluid flow channel, and an outflow port for the first fluid on another end of the first fluid flow channel;

a stacked core that is accommodated in the duct and includes a plurality of tubes having flat shapes and being stacked in a tube stacking direction, a second fluid flow channel provided inside each of the plurality of tubes through which a second fluid passes, and outer fins arranged between adjacent tubes of the plurality of tubes, the tubes and the outer fins being joined to each other; and a coupling plate that is joined to the duct and has a groove defining a peripheral edge of the inflow port or the outflow port, wherein a direction intersecting with the tube stacking direction and the first fluid flow direction is defined as a core width direction, the duct includes a first plate disposed to face at least one of end faces of the stacked core in the core width direction, and a second plate disposed to face at least one of end faces of the stacked core in the tube stacking direction, and the second plate includes a second-plate end plate portion disposed to face the end face of the stacked core in the core width direction and directly joined to a wall surface of the first plate that faces in the core width direction, a second-plate center plate portion disposed to face the end face of the stacked core in the tube stacking direction, and a flange portion that extends in the tube stacking direction and is joined to a bottom wall surface of the groove of the coupling plate.

2. The heat exchanger according to claim 1, wherein the flange portion has a surface extending outward of the duct from an edge portion of the second plate which is located on an end of the second plate in the flow direction of the first fluid.

3. The heat exchanger according to claim 1, wherein the duct is formed into the tubular shape by combination of one first plate and one second plate, the first plate includes first-plate end plate portions disposed to face the respective end faces of the stacked core in the core width direction, and a first-plate center plate portion that is disposed to face one end face of the stacked core in the tube stacking direction and couples the first-plate end plate portions, and the second plate is disposed to face another end face of the stacked core in the tube stacking direction.

4. The heat exchanger according to claim 1, wherein the duct is formed into the tubular shape by combination of two first plates and two second plates, one first plate of the two first plates is disposed to face one end face of the stacked core in the core width direction, and another first plate is disposed to face another end face of the stacked core in the core width direction, and one second plate of the two second plates is disposed to face one end face of the stacked core in the tube stacking direction, and another second plate is disposed to face another end face of the stacked core in the tube stacking direction.

5. The heat exchanger according to claim 1, wherein the first plate includes a sealing protrusion with which a meeting gap generated in a meeting portion between the first plate, the second plate and the coupling plate is filled.

6. The heat exchanger according to claim 5, wherein a surface of the sealing protrusion facing the meeting gap is flat, and surfaces of the second plate and the coupling plate facing the meeting gap are rounded.

7. The heat exchanger according to claim 6, wherein the first plate includes first-plate end plate portions that are disposed to face the an angle of a surface of the sealing protrusion facing the meeting gap with respect to the first-plate end plate portion is 45 degrees or more.

8. The heat exchanger according to claim 5, wherein a surface of the sealing protrusion facing the meeting gap is rounded, and surfaces of the second plate and the coupling plate facing the meeting gap are flat.

9. The heat exchanger according to claim 5, wherein a surface of the sealing protrusion facing the second plate and the meeting gap is rounded, and a surface of the sealing protrusion facing the coupling plate and the meeting gap is flat, and surfaces of the second plate and the coupling plate facing the meeting gap are rounded.

10. The heat exchanger according to claim 5, wherein a surface of the sealing protrusion facing the second plate and the meeting gap is flat, and a surface of the sealing protrusion facing the coupling plate and the meeting gap is rounded, and surfaces of the second plate and the coupling plate facing the meeting gap are rounded.

11. The heat exchanger according to any one of claim 1, further comprising a sealing member inserted into a gap generated in a meeting portion between the first plate, the second plate and the coupling plate such that the gap is filled with the sealing member.

12. The heat exchanger according to claim 1, wherein the first plate includes a positioning portion that contacts the bottom wall surface to set relative positions of the first plate and the coupling plate in the first fluid flow direction.

13. The heat exchanger according to claim 1, wherein at least one of the inflow port of the first fluid and the outflow port of the first fluid, in which the coupling plate is disposed, is rectangular.

14. The heat exchanger according to claim 1, wherein the coupling plate includes: an inner wall surface that is erected from an inner peripheral side edge of the bottom wall surface, and a locking portion that protrudes from the inner wall surface toward the first fluid flow channel and is engageable with the end face of the first plate in the first fluid flow direction.

15. The heat exchanger according to claim 14, wherein the locking portion is provided over an entire circumference of the inner wall surface.

16. The heat exchanger according to claim 14, wherein the locking portion connects portions of the inner wall surface which face each other.

17. The heat exchanger according to claim 1, wherein the second-plate end plate portion of the second plate and the wall surface of the first plate are joined at a first joining location, the flange portion of the second plate and the bottom wall surface of the groove of the coupling plate are joined at a second joining location, and the first and second joining locations are located on an external surface of the heat exchanger.

18. A heat exchanger, comprising:

a duct including at least two plates combined into a tubular shape, a first fluid flow channel provided inside the duct through which a first fluid passes, an inflow port for the first fluid on one end of the first fluid flow channel, and an outflow port for the first fluid on another end of the first fluid flow channel;

a stacked core that is accommodated in the duct and includes a plurality of tubes having flat shapes and being stacked in a tube stacking direction, a second fluid flow channel provided inside each of the plurality of tubes through which a second fluid passes, and outer fins arranged between adjacent tubes of the plurality of tubes, the tubes and the outer fins being joined to each other; and a coupling plate that is joined to the duct and has a groove portion defining a peripheral edge of the inflow port or the outflow port, wherein the duct includes a first plate having a wall surface extending in the tube stacking direction, and a second plate disposed to face at least one of end faces of the stacked core in the tube stacking direction, and the second plate includes a second-plate end plate portion that extends in the tube stacking direction and is directly joined to a wall surface of the first plate that faces in the core width direction, a second-plate center plate portion disposed to face the end face of the stacked core in the tube stacking direction, and a flange portion that extends from at least the second-plate center plate portion in the tube stacking direction and is joined to a bottom wall surface of the groove of the coupling plate.

19. The heat exchanger according to claim 18, wherein the second-plate end plate portion of the second plate and the wall surface of the first plate are joined at a first joining location, the flange portion of the second plate and the bottom wall surface of the groove of the coupling plate are joined at a second joining location, and the first and second joining locations are located on an external surface of the heat exchanger.

20. A heat exchanger, comprising:

a duct including a first plate and a second plate combined into a tubular shape, a first fluid flow channel provided inside the duct through which a first fluid passes, an inflow port for the first fluid on one end of the duct in a first fluid flow direction, and an outflow port for the first fluid on another end of the duct in the first fluid flow direction;

a stacked core that is accommodated in the duct and includes a plurality of tubes having flat shapes and being stacked in a tube stacking direction, a second fluid flow channel provided inside each of the plurality of tubes through which a second fluid passes, and outer fins arranged between adjacent tubes of the plurality of tubes, the tubes and the outer fins being joined to each other; and coupling plates that have frame shapes and are joined to both end portions of the duct in the first fluid flow direction to define the inflow port and the outflow port without the coupling plates being in contact with the plurality of tubes, wherein a direction perpendicular to the tube stacking direction and the first fluid flow direction is defined as a core width direction, the first plate includes first-plate both end plate portions disposed to face both end faces of the stacked core in the core width direction and joined to the stacked core, a first-plate center plate portion disposed to face one end face of the stacked core in the tube stacking direction and joined to the stacked core, and first plate flange portions that extend outward from both end portions of the first plate in a direction intersecting the first fluid flow direction and have surfaces facing the coupling plates and being perpendicular to the first fluid flow direction, the second plate includes second-plate both end plate portions disposed to face both end faces of the stacked core in the core width direction and joined to the stacked core, a second-plate center plate portion disposed to face another end face of the stacked core in the tube stacking direction and joined to the stacked core, and second plate flange portions that extend outward from both end portions of the second plate in a direction intersecting the first fluid flow direction and have surfaces facing the coupling plate and being perpendicular to the first fluid flow direction, the first-plate both end plate portions and the second-plate both end plate portions are joined at positions where overlapped with each other in the core width direction, and the first plate flange portions and the second plate flange portions are joined to bottom wall surfaces of the coupling plates which are perpendicular to the first fluid flow direction.

21. The heat exchanger according to claim 20, wherein the first-plate both end plate portions, the second-plate both end plate portions or both portions include relief plate portions such that gaps are defined between the relief plate portions and the both end faces of the stacked core in the core width direction, and the first-plate both end plate portions or the second-plate both end plate portions are disposed in the gaps.

22. The heat exchanger according to claim 21, wherein the relief plate portions include two relief plate portions provided on the first-plate both end plate portions or the second-plate both end plate portions.

23. The heat exchanger according to claim 21, wherein the relief plate portions include one relief plate portion provided on the first-plate both end plate portions and one relief plate portion provided on the second-plate both end plate portions.

24. The heat exchanger according to claim 20, wherein the first- plate both end plate portions include positioning protrusions that contact a bottom wall surface of the coupling plates and wherein relative positions of the first plate and the coupling plates are set by an abutment between the positioning protrusions and the bottom wall surface of the coupling plates when the first plate and the coupling plates are assembled together.

25. The heat exchanger according to claim 24, wherein the first- plate both end plate portions include sealing protrusions and wherein gaps between the first-plate both end plate portions, the second-plate both end plate portions, and the coupling plates are filled with the sealing protrusions.

26. The heat exchanger according to claim 20, wherein:

the first-plate both end plate portions and the second-plate both end plate portions are joined at first positions located on an external surface of the heat exchanger and the first plate flange portions; and the second plate flange portions and the second plate flange portions are joined to the bottom wall surfaces of the coupling plates at second positions located on the external surface of the heat exchanger.

27. The heat exchanger according to claim 20, wherein the direction in which the first flange portions extend and the direction in which the second flange portions extend are perpendicular to the first fluid flow direction.

28. A heat exchanger, comprising:

a duct including a first plate and a second plate combined into a tubular shape, a first fluid flow channel provided inside the duct through which a first fluid passes, an inflow port for the first fluid on one end of the duct in a first fluid flow direction, and an outflow port for the first fluid on another end of the duct in the first fluid flow direction;

a stacked core that is accommodated in the duct and includes a plurality of tubes having flat shapes and being stacked in a tube stacking direction, a second fluid flow channel provided inside each of the plurality of tubes through which a second fluid passes; and a coupling plate that is joined to the duct and includes a groove portion defining the inflow port or the outflow port without the coupling plates being in contact with the plurality of tubes, wherein the first plate includes a pair of first-plate both end plate portions that extends in the tube stacking direction, a first-plate center plate portion that connects the first-plate both end plate portions to each other and is disposed to face one end face of the stacked core in the tube stacking direction, a first plate flange portion that extends outward from both end portions of the first plate in a direction intersecting the first fluid flow direction and is joined to a bottom wall surface of the groove portion of the coupling plate, and the second plate includes a pair of second-plate both end plate portions that extend in the tube stacking direction and are overlapped with and joined to the first-plate both end plate portions, a second-plate center plate portion that connects the second-plate both end plate portions to each other and is disposed to face another end face of the stacked core in the tube stacking direction, and a second plate flange portion that extends outward from both end portions of the second plate in a direction intersecting the first fluid flow direction and is joined to the bottom wall surface of the groove portion of the coupling plate.

29. The heat exchanger according to claim 28, wherein the pair of second-plate both end plate portions of the second plate and the pair of first-plate both end plate portions are joined at a first joining location, the second plate flange portion of the second plate and the bottom wall surface of the groove of the coupling plate are joined at a second joining location, and the first and second joining locations are located on an external surface of the heat exchanger.

30. The heat exchanger according to claim 28, wherein the direction in which the first flange portion extends and the direction in which the second flange portion extends are perpendicular to the first fluid flow direction.

* * * * *